US010770824B2

(12) United States Patent
Upson et al.

(10) Patent No.: US 10,770,824 B2
(45) Date of Patent: Sep. 8, 2020

(54) CONNECTOR WITH CONNECTOR POSITION ASSURANCE

(71) Applicant: J.S.T. Corporation, Farmington Hills, MI (US)

(72) Inventors: Gwendolyn Upson, Ypsilanti, MI (US); Ping Chen, Novi, MI (US); Eric Blankinship, Farmington Hills, MI (US); Zachary Graham, Grosse Pointe Park, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 335 days.

(21) Appl. No.: 15/256,454

(22) Filed: Sep. 2, 2016

(65) Prior Publication Data

US 2016/0372867 A1 Dec. 22, 2016

Related U.S. Application Data

(63) Continuation-in-part of application No. 15/050,168, filed on Feb. 22, 2016, now Pat. No. 10,014,618, and a continuation-in-part of application No. PCT/US2015/016979, filed on Feb. 20, 2015.

(51) Int. Cl.

| | |
|---|---|
| ***H01R 43/20*** | (2006.01) |
| ***H01R 13/50*** | (2006.01) |
| ***H01R 13/436*** | (2006.01) |
| *H01R 13/432* | (2006.01) |
| *H01R 13/627* | (2006.01) |

(52) U.S. Cl.
CPC ..... *H01R 13/501* (2013.01); *H01R 13/4361* (2013.01); *H01R 13/432* (2013.01); *H01R 13/6272* (2013.01); *Y10T 29/53209* (2015.01)

(58) Field of Classification Search
CPC ..... H01R 13/6272; H01R 13/629; H01R 13/4361; H01R 13/501; H01R 13/64; H01R 9/24; Y10T 29/49826; Y10T 403/595; Y10T 403/608; Y10T 29/53209
USPC ..... 29/428, 453, 525, 854, 857, 874, 876, 29/747, 729, 752, 754, 761
See application file for complete search history.

(56) References Cited

U.S. PATENT DOCUMENTS 4,721,482 A * 1/1988 Fukuda ..... H01R 13/4223 439/586

* cited by examiner

*Primary Examiner* — Thiem D Phan

(57) ABSTRACT

A system and method are described for improved connector position assurance. A latch stop mechanism (10) on a first connector may be used to selectively limit movement of a latch (50) and attached latch lock (54) after the latch lock (54) has been engaged to secure the first connector to a second connector. The latch stop mechanism (10) may be attached to the connector housing (80) and have a series of hinges (12), (16) that allow a latch stop mechanism (10) to pivot into place, limiting movement of the latch (50) and latch lock (54). A terminal position assurance (TPA) (30) may be located on the bottom of the connector main body and when engaged, ensures proper positioning of the engaged wire terminal.

10 Claims, 33 Drawing Sheets

CONNECTOR WITH CONNECTOR POSITION ASSURANCE

TECHNICAL FIELD

A system and method are described for providing improved connector and terminal position assurance. This invention relates especially to electrical connectors and connector position assurance, and also to connector systems that may have a terminal, a female connector, and a male connector. The invention further relates to methods for connecting using the improved connector position assurance of the present invention.

BACKGROUND ART

Numerous connector systems have been developed, and especially relating to electrical connectors. It is common to have male and female connector portions. Various locking mechanisms have been devised to secure connectors in a connected position. These may include generally, the use of a latch member. Latch securing methods have been previously investigated, including sliding latch securing mechanisms. However, it is believed that hinged options so far have not been available to practically and reliably secure a latch, especially where a latch stop is attached to a connector housing such that it may pivot into the connector to secure a latch.

DISCLOSURE OF THE INVENTION

The present invention is intended to provide improved connector and terminal position assurance that may be used to secure engagement between a first and second connector and a wire terminal with a connector main body, respectively. A latch stop mechanism on a first connector may be used to selectively limit movement of a latch and an attached latch lock after the latch lock has been engaged to secure the first connector to the second connector. The latch stop mechanism may be attached to the connector housing and have a series of hinges that allow a latch stop to pivot into place, preferably locking with a latch, limiting movement of the latch and latch lock.

The latch and latch lock are thereby secured by the latch stop in a position engaging the latch lock with the second connector. This serves to provide improved connector position assurance.

The invention is described in further detail in the drawings and the detailed description below.

DETAILED DESCRIPTION OF THE INVENTION

Figure 1:
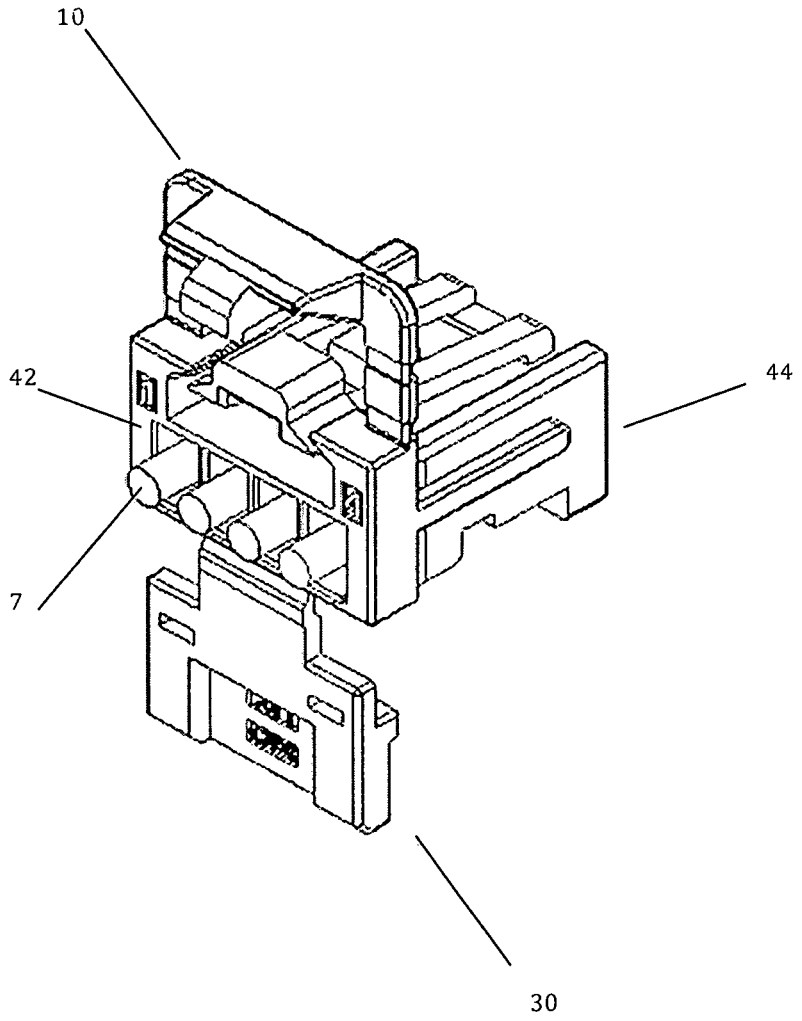
FIG. 1 is a perspective view of a female connector according to the present invention, with a latch stop mechanism, and connector position assurance and a terminal position assurance attached to the top and bottom of the female connector housing, respectively.

The present invention offers an improved connector position assurance mechanism. A connector system according to the present invention is illustrated in FIG. 1. A female connector is shown having a front 44 and rear 42. This particular variant has four wires 7. The improved connector position assurance of the present invention is provided by a latch stop mechanism 10 that may be attached to the top of the connector. A terminal position assurance ("TPA") 30 may be provided on the bottom of the connector.

Figures 2A, 2B, 2C:
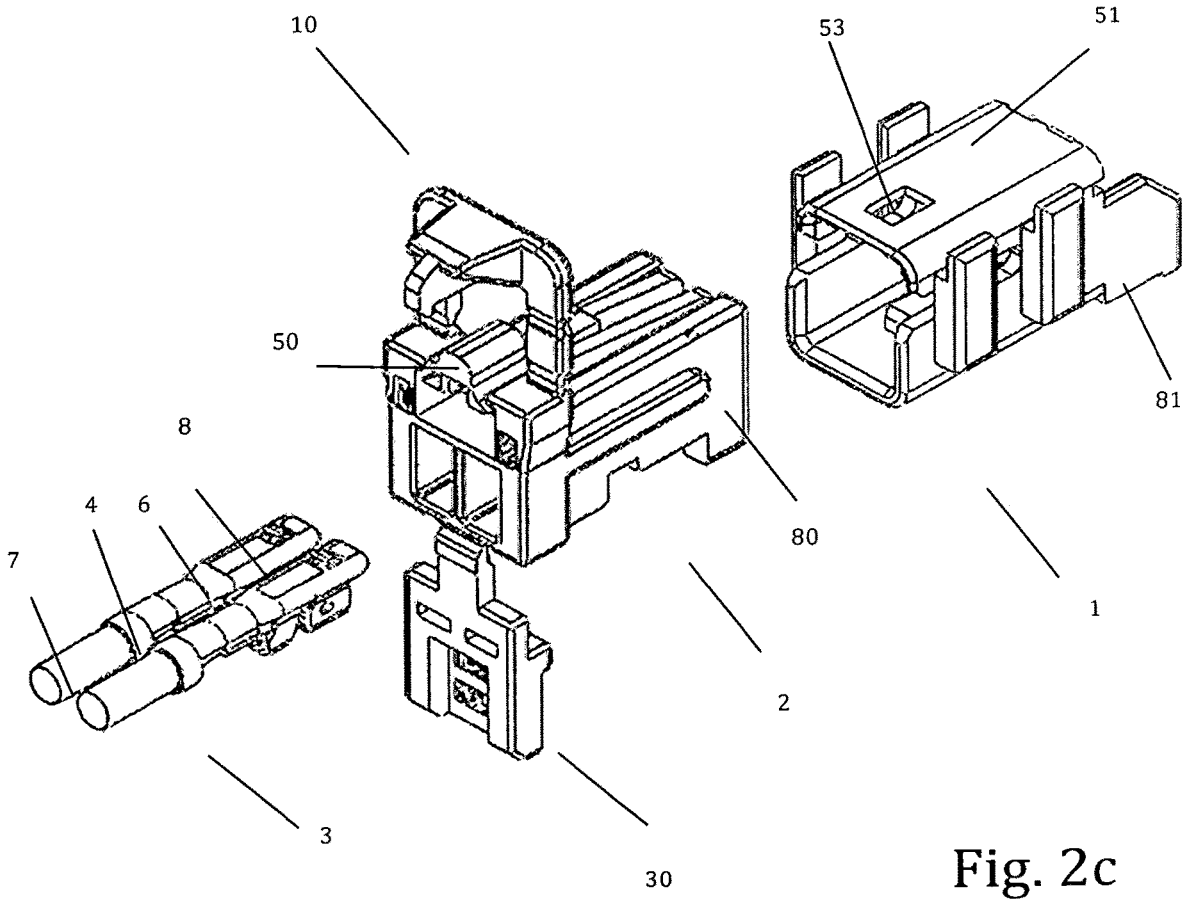
FIGS. 2*a*, 2*b*, and 2*c* are an exploded view of a terminal, female connector, and male connector, according to the present invention.

One embodiment of the invention shown in FIG. 2*b* comprises a connector housing 80, a latch 50 adjoining the connector housing, and a latch stop mechanism 10 adjoining the connector housing. This is a two-wire, (two-pin) variant, with the wire terminal 3 shown in FIG. 2*a*. A wire 7 passes through the wire crimp 4. The conductor passes through the core crimp 6. A terminal lock 8 comprises an inclined surface that may deflect as it passes the terminal lock catch 86, shown in FIG. 8, in the connector housing. When connected, the terminal lock 8 is secured by the terminal lock catch 86.

Connectors that may be used in the present invention include various types of connectors, but especially male and female connectors having housings. For a connector housing, the front of the housing may be considered the portion of the housing nearest the surface that mates with another connector.

The present invention may employ a latch 50 with a latch lock 54 to engage two connectors. A typical latch of the present invention may be seen in FIG. 7, and comprises a connection such as a hinge 52 to the connector housing. One or more beams 56 may extend from a hinge or hinges 52, supporting a latch lock 54. It is not necessary that the latch has a latch hinge, especially if the beam is sufficiently long and attached to the housing so that it may sufficiently deflect to engage or disengage the latch lock 54. The latch lock 54 may be rigidly attached to the latch beam 56, or it may be positioned so that it is not directly on the beam 56, but is supported by the beam 56 so that when the beam moves upward, the latch lock 54 also moves upward.

Figure 5:
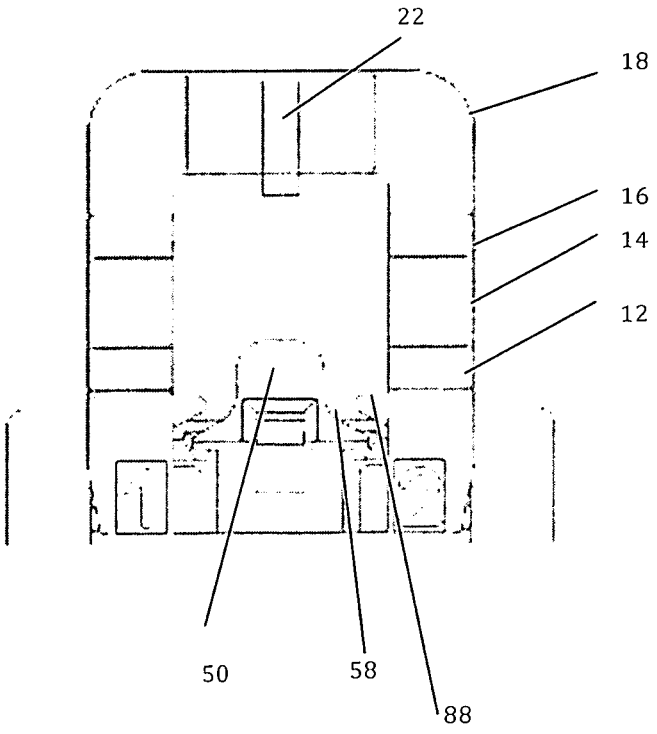
FIG. 5 is a rear view of the upper portion of a female connector of the present invention with a latch stop mechanism connected to the female connector housing.
Figure 7:
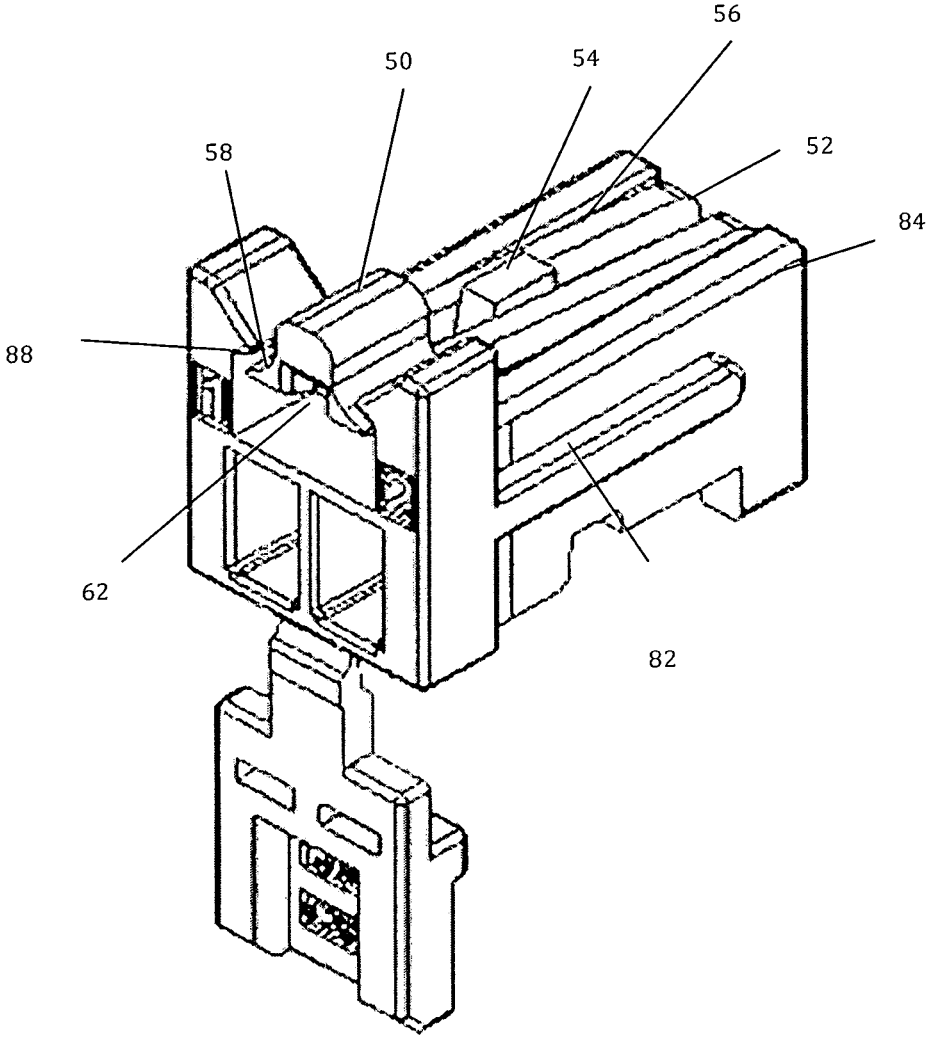
FIG. 7 is a perspective view of a female connector with an exposed latch and a terminal position assurance of the present invention.

The latch 50 of the present invention may also include a latch stop contact surface 66 to interact with the latch stop surface 68. The latch 50 may also have a cavity 62, as shown in FIG. 7, to facilitate movement of the latch stop arm 22 toward the latch stop contact surface 66. When the latch stop mechanism 10 is not engaged, the latch cavity 62 provides space into which the latch 50 may be depressed, allowing the connectors to be engaged or disengaged. Protrusions on either side of the cavity can provide overstress protection for the latch. As shown in FIG. 5, a latch overstress protection surface 58 on the latch and a latch overstress protection surface 88 on the female connector housing limit upward movement of the latch 50. Additional overstress protection surfaces may limit downward movement of the latch. A catch surface 64 may be included on the latch 50 to secure the locking surface of latch stop lock 26.

In the present invention, it is preferred that one connector have a latch lock 54 that may be engaged with a corresponding latch securing surface on the second connector. For example, a latch lock 54 may be depressed, deflecting the latch beam 56. A housing of a second connector may slide over the latch lock until a latch securing surface of the second connector housing is in position. The latch lock 54 may then be raised into contact with the latch securing surface. In a preferred embodiment of the present invention, the latch lock 54 may be positioned in a latch lock window 53 in the second connector housing. One or more sides of the latch window may serve as a latch securing surface.

The improved connector position assurance of the present invention operates to ensure that the latch lock 54 remains engaged with the latch securing surface. This is accomplished by employing a latch stop mechanism 10 that limits movement of the latch 50 and attached latch lock 54. A latch stop mechanism 10 conveniently is attached to the connector housing in such a way that it may be manipulated to limit movement of the latch.

The latch stop mechanism 10 of the present invention may have a series of hinges and sections with a latch stop attached to a distal section. Preferably, the latch stop mechanism 10 has a proximal hinge 12, a distal hinge 16, a proximal section 14 between the proximal hinge 12 and the distal hinge 16, a distal section 18 situated on a side of the distal hinge opposite the proximal section, and a latch stop disposed on the distal section.

It is preferred that sections 14 and 18 of the present invention are structural members sufficiently rigid to support a latch stop arm 22 and work in concert with the hinges 12 and 16. The sections may be planar or of any other suitable shape or construction.

The term "hinge" is intended to mean a moveable joint. The hinge of the present invention allows members of the latch stop mechanism 10 to pivot around a portion of the connector housing. Preferably, movement is in one plane, so that the latch stop surface 68 remains in alignment as it moves toward the latch cavity 62 and arrives at the latch stop contact surface 66 of the latch. The hinges of the present invention serve to pivotably join two members, each member on an opposite side of the hinge. Accordingly, each hinge has two sides, each side corresponding to a member joined by the hinge.

In a preferred embodiment, one or more hinges of the latch stop mechanism 10 may be a live hinge. It is preferred that the latch stop mechanism 10 have at least two live hinges.

By bending the hinges of the latch stop mechanism 10, it is possible to position the latch stop arm 22 toward the latch cavity 62, and ultimately position the latch stop surface 68 against the latch stop contact surface 66 of the latch, so that the latch 50 cannot be deflected downward.

The latch stop mechanism 10 may comprise a latch stop arm 22 extending outward from the distal section 18 of the latch stop mechanism 10. The latch stop arm 22 may have a latch stop surface 68 and may also have a locking surface 28 to lock the latch stop surface into place. The term "latch stop" includes the latch stop surface 68 and the structure on which this surface is disposed. For example, the latch stop may include an arm, a wedge, or both. The latch stop may have one or more inclined surfaces, especially on or about the latch stop arm 22. Preferably, there is a wedge 24 projecting from the distal section 18 of the latch stop mechanism 10. The wedge 24 may be inserted into the latch cavity 62. The wedge 24 may assist pushing the lower surface of the latch 50 upward, and ultimately facilitate contact between the latch stop surface 68 and latch stop contact surface 66 of the latch.

When the latch stop contact surface 66 contacts the latch stop surface 68, movement of the latch 50 is limited. Thus, the latch lock 54 may not be disengaged from the latch lock window 53 unless the latch stop surface 68 is removed from the latch cavity 62. Further, in a preferred embodiment, the latch stop surface 68 may not be removed from the latch cavity 62 so long as the latch stop locking surface 28 remains in contact with a latch stop catch surface 64. Both the latch stop lock 26 on the latch stop and the latch stop catch surface 64 on the latch 50 may comprise inclined planes. An inclined plane on either the catch or lock surfaces may help guide the lock into place. Preferably, the latch stop lock 26 is disposed on the latch stop arm 22. The lock may have an inclined plane that guides the locking surface 28 toward the catch surface 64. The catch may have a corresponding inclined plane and corresponding catch surface.

The portion of the latch stop arm 22 that enters the latch cavity 62 may be shaped to facilitate entry into the latch cavity. The distal portion of the latch stop arm 22 may be rounded. Edges may feature chamfers.

In a preferred embodiment, a latch stop comprises a latch stop arm 22 and a latch stop wedge 24. The latch stop is centered on a distal section that is part of a hinged frame with two proximal hinges, two proximal sections, and two distal hinges. One result of this hinged frame is an opening through which the latch 50 may protrude when the latch stop mechanism 10 is bent and the latch stop is positioned against the latch stop contact surface 66.

Figure 8:
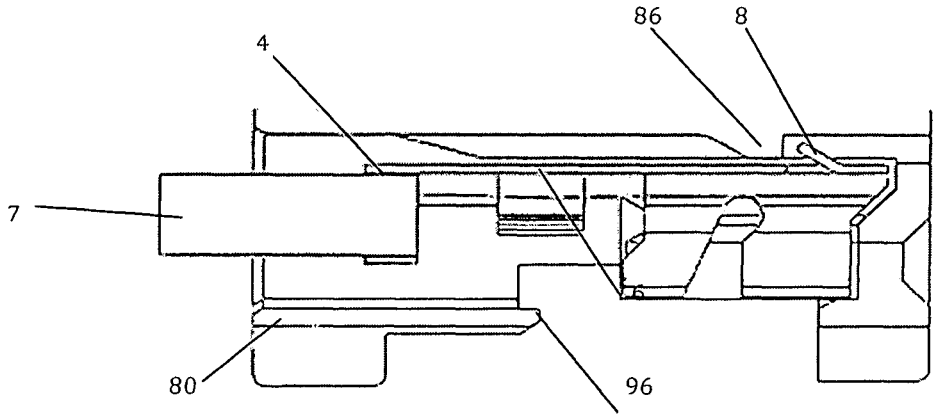
FIG. 8 is a longitudinal sectional view of a terminal inserted into a connecter of the present invention.

FIGS. 2*a*, 2*b*, and 2*c* illustrate one such preferred embodiment. The wire terminal 3 of FIG. 2*a* is inserted into the wire cavities of the female connector 2 in FIG. 2*b*. A terminal 3 that is inserted and locked into a connector housing is shown in FIG. 8, with the terminal lock 8 in contact with terminal lock catch 86. When the terminal 3 is in place, a terminal position assurance catch 96 on the terminal is exposed and in position so that it may secure the terminal position assurance lock 36.

The male connector 1 in FIG. 2*c* is positioned so that the male connector housing 81 slides over portions of the female connector housing 80. A latch lock disposed on a latch beam may be depressed enabling the top wall 51 of the male connector housing to pass over the latch beams and latch lock on the female connector. When in position, the latch lock may pass through the latch lock window 53. The latch stop mechanism 10 may be contacted with the latch, limiting movement of the latch lock and securing it in place. Terminal position assurance 30 may be pivoted until lit locks with a catch on the terminal 3.

Figure 4:
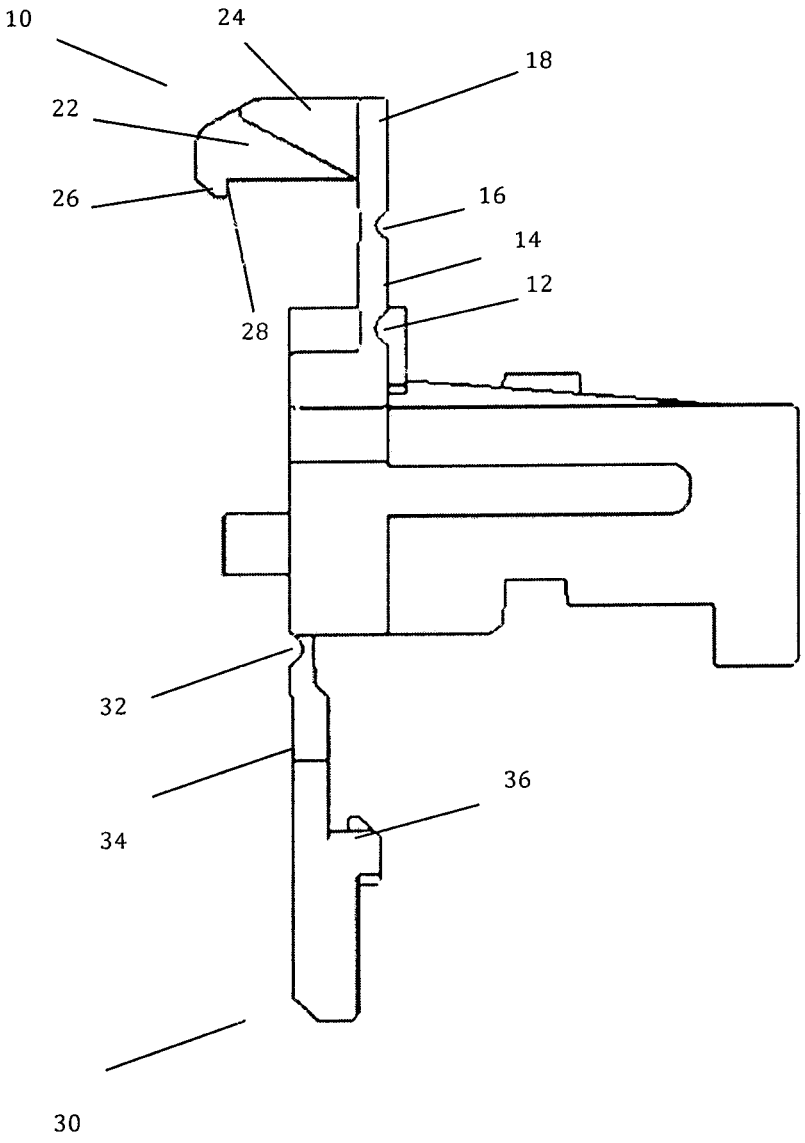
FIG. 4 is a side view of a female connector of the present invention with a latch stop mechanism, and a connector position assurance and a terminal position assurance attached to the top and bottom of the female connector housing, respectively.

FIG. 4 illustrates the structure of the terminal position assurance 30. Terminal position assurance hinge 32 is attached to the lower portion of the female connector housing. A terminal position assurance beam 34 is connected to the hinge 32 allowing the beam to pivot relative to the connector housing. A terminal position assurance lock 36 is positioned to contact a corresponding terminal position assurance catch on the wire terminal 96.

Figure 3:
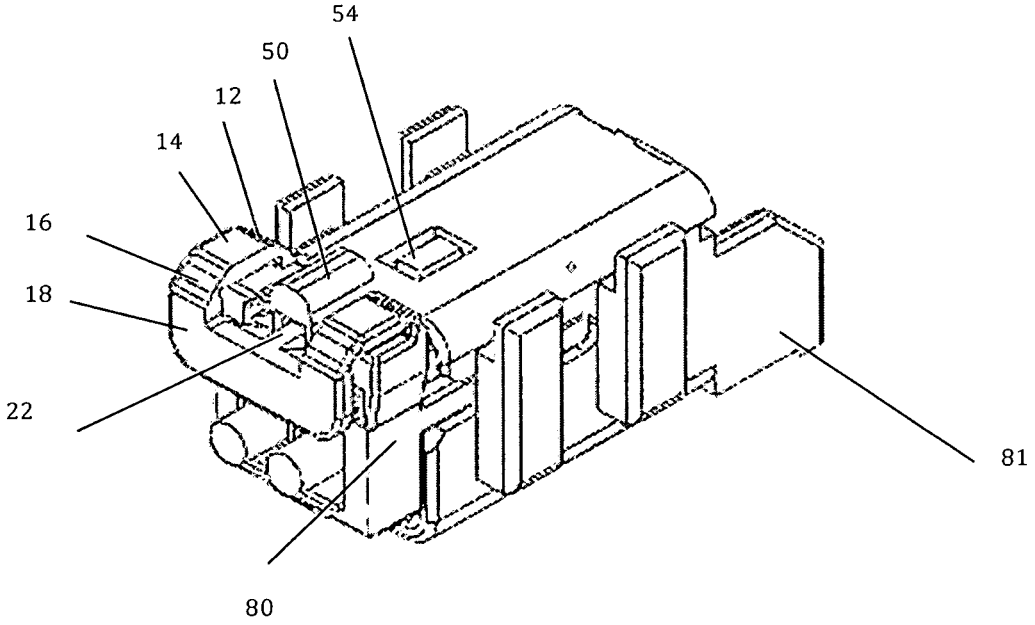
FIG. 3 is a perspective view of a male connector connected to a female connector according to the present invention, with a latch stop mechanism engaged with the latch.

FIG. 3 shows the connector position assurance of the present invention as used in a mated female and male connector system. Male connector housing 81 has been positioned over the female connector housing 80. The latch lock 54 is engaged with the latch lock window 53. The latch stop mechanism 10 has been bent using two sets of hinges, positioning the latch stop arm 22 in the latch cavity 62.

FIG. 4 shows further details of the latch stop mechanism 10 of a preferred embodiment of the present invention. This view shows that the live hinges and the members they connect are continuous. The live hinges connect rigid members, all of which are made of the same injection molded material. At the position of the live hinge, there is a thinned or cut portion allowing the rigid members to bend along the hinge line. A proximal live hinge 12 is disposed on the top of the female connector housing. It is connected to the proximal section 14, which serves to extend the pivot point of the distal hinge 16. The position of the proximal hinge 12 on the connector housing near the top of the latch 50, and the length of the proximal and distal sections are optimized to allow the latch stop surface to contact the latch without the latch stop mechanism interfering with other structures of the connector housing or the wire terminal. The distal section serves to support the latch stop, which in this embodiment, includes the latch stop arm 22 and latch stop wedge 24.

Figure 6:
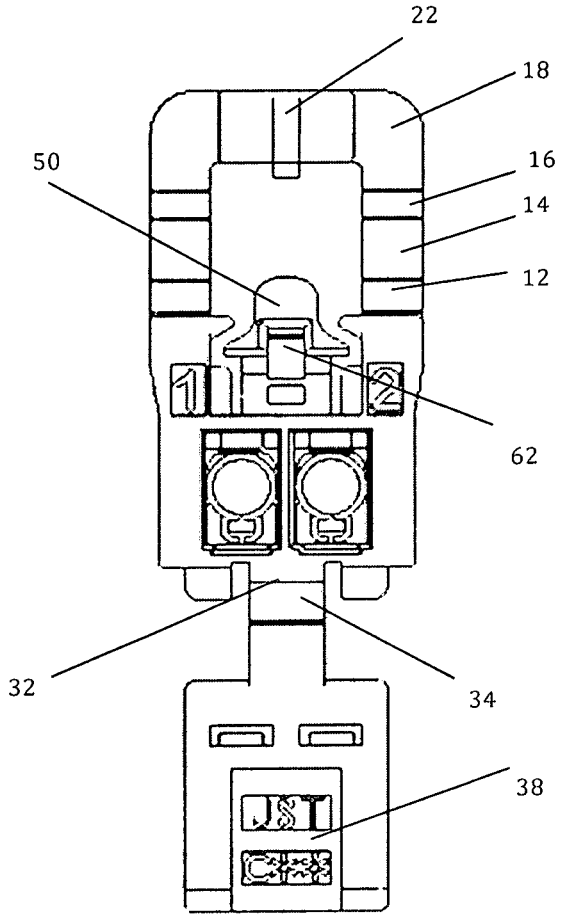
FIG. 6 is a rear view of a female connector of the present invention with a latch stop mechanism, and a connector position assurance and a terminal position assurance attached to the top and bottom of the female connector housing, respectively.

Front views in FIG. 5 and FIG. 6 further illustrate the latch stop mechanism of a preferred embodiment where the latch stop mechanism 10 comprises a hinged frame with an opening to accommodate latch 50. In FIG. 6, the anti-scooping feature 38 of the terminal position assurance is shown.

Figure 10:
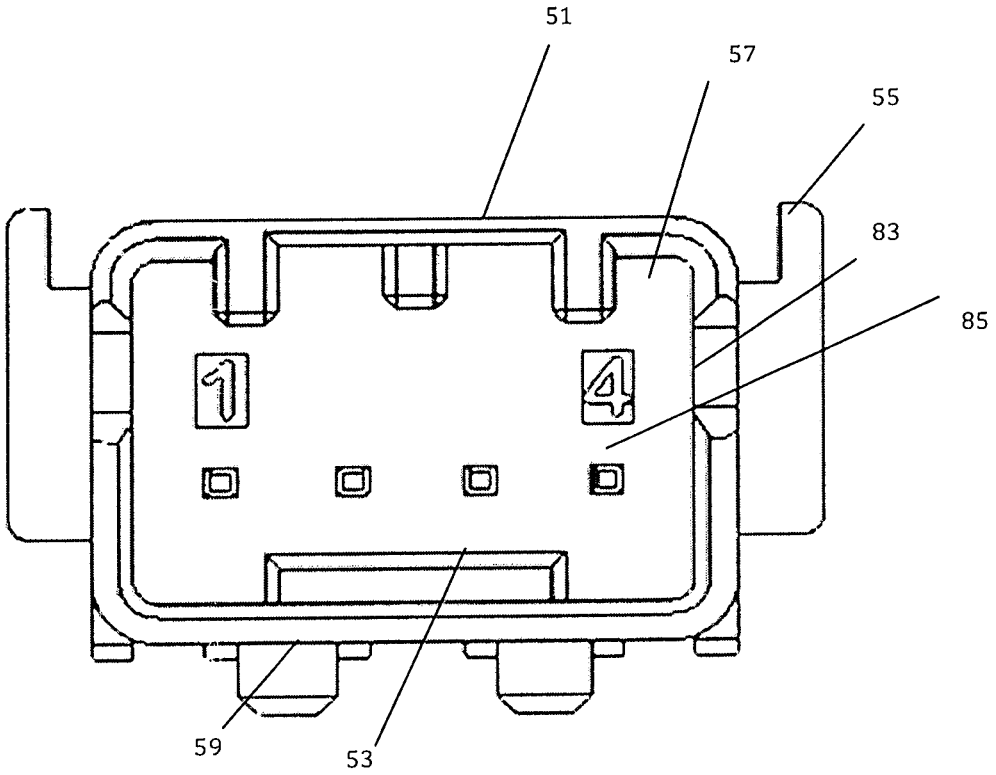
FIG. 10 is a front view of a male connector of the present invention.

FIG. 7 illustrates an embodiment of the present invention without the latch stop mechanism 10. In addition to more clearly showing the structures of the latch, FIG. 7 also shows keying feature 82 and polarization feature 84. These structures on the connector housing serve to align the female connector with the male connector. Corresponding features on the male connector housing are shown in FIG. 10, which depicts a polarization feature slot 57 and a keying slot 83. Also illustrated are the reinforcing tab 55, locating pin 59, and male connector anti-scooping feature 63. FIG. 10 additionally shows the pin 85 that may be inserted into the terminal. The male connector housing in FIG. 10 is a four-pin variant. The present invention may be applied to connectors of various types and sizes, including a suitable number of pins.

Figure 9A:
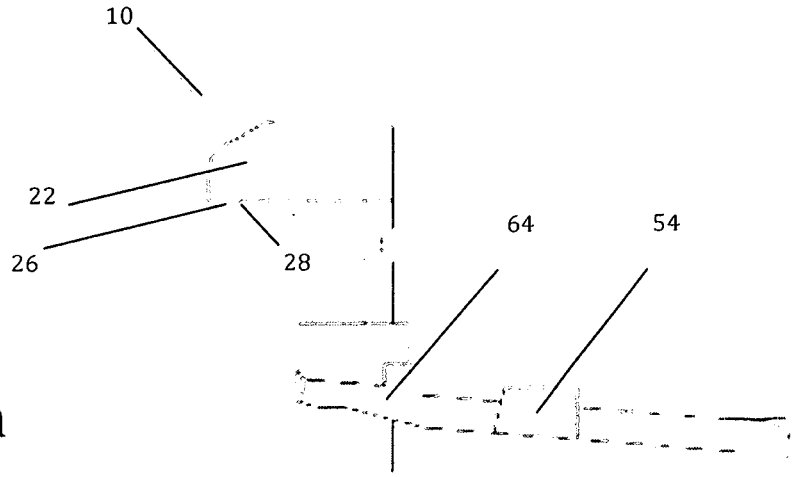
FIGS. 9*a*, 9*b*, and 9*c* are side views of the top portion of a connector of the present invention with a latch stop mechanism illustrated before, during, and after engaging with the latch.
Figure 9B:
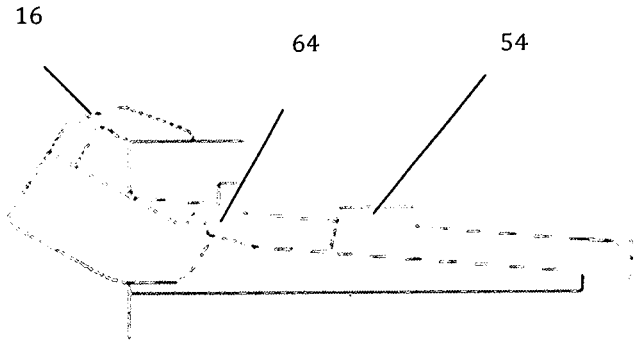
Figure 9C:
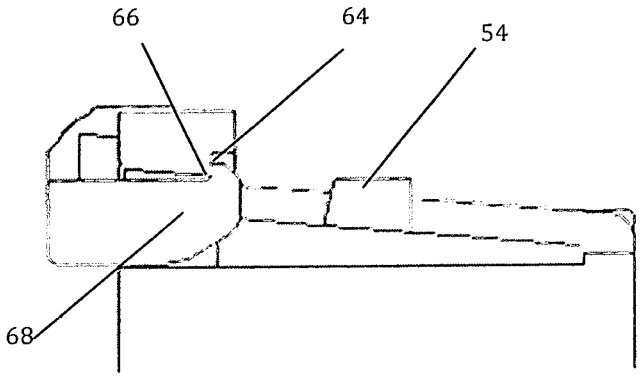

FIGS. 9*a*, 9*b*, and 9*c* demonstrate operation of the connector position assurance method of the present invention. A latch stop mechanism 10 initially extends away from the connector housing. The latch stop mechanism is moved by bending a proximal hinge and bending a distal hinge of a latch stop mechanism. The invention is not limited to a particular order of bending the hinges. As the hinges bend, the latch stop moves toward the latch and latch cavity. As the hinges bend further, the latch stop contacts the latch, more particularly the latch stop surface 68 comes into contact with the latch stop contact surface 66.

In a preferred embodiment, the latch stop is wedged against the latch stop contact surface 66. This does not necessarily mean that a wedge 24 is in contact with the latch stop contact surface 24. The latch stop locking surface 28 on the latch stop lock 26 locks with the latch stop catch surface 64.

In a preferred embodiment, a female connector, a terminal, latch, and latch stop are provided. The female connector is aligned with the male connector. The latch on the female connector is deflected and a latch lock on the female connector is engaged with a latch window on the male connector. A coupling surface on the latch lock is contacted with a latch securing surface on the latch window, causing the male and female connectors to be coupled.

The terms "coupled" and "coupling" as used herein are not limited to their technical definition in the electrical arts. Rather these terms are used according their general meaning in the way two objects, such as railroad cars, may be mechanically coupled. Thus, the male connector and female connector are coupled by the latch lock passing through the latch window, The operation of the latch stop mechanism, as shown in FIG. 9*c* prevents downward movement of the latch and latch lock, maintaining the latch lock in a coupled position.

The many features and advantages of the present invention are apparent from the written description and, thus, it is intended by the appended claims to cover all such features and advantages of the invention. Further, since numerous modifications and changes will readily occur to those skilled in the art, it is not desired to limit the invention to the exact construction and operation as illustrated and described. Hence, all suitable modifications and equivalents may be included as falling within the scope of the invention.

Figures 11A, 11B, 11C, 11D, 11E:
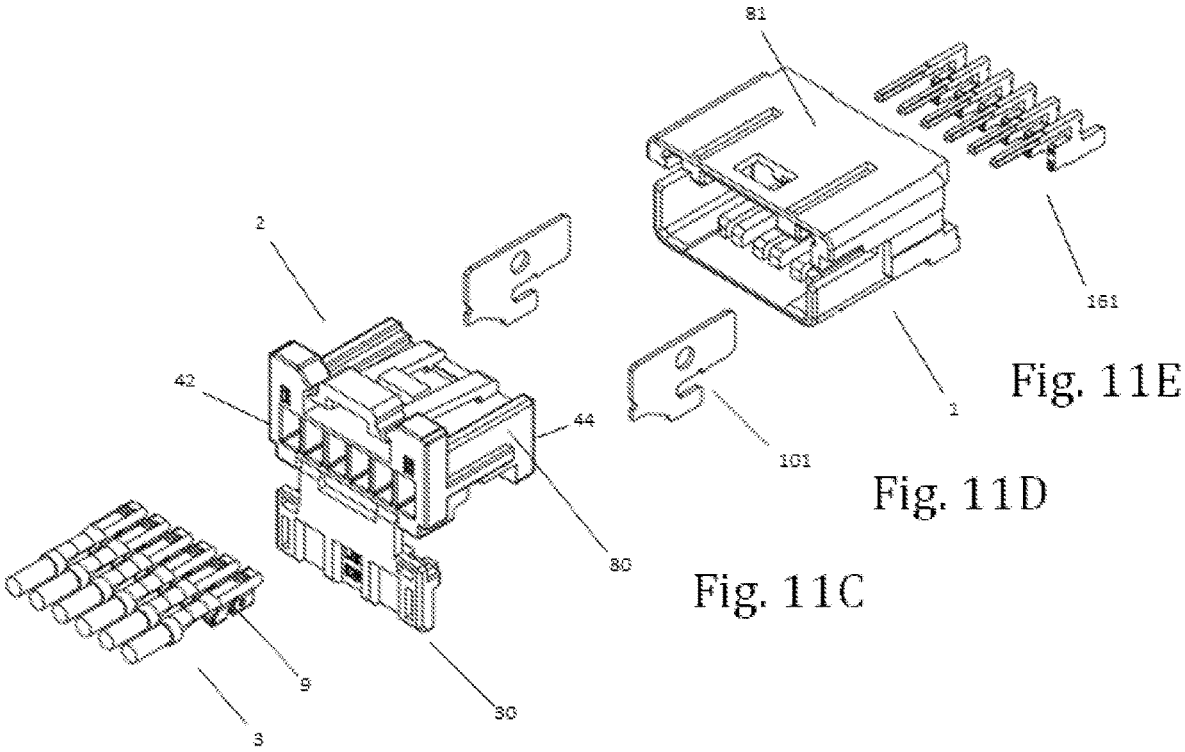
FIGS. 11*a*, 11*b*, 11*c*, 11*d*, and 11*e* are an exploded view of a wire terminal, female connector, reinforcement tabs, male connector, and male pins.
Figure 12:
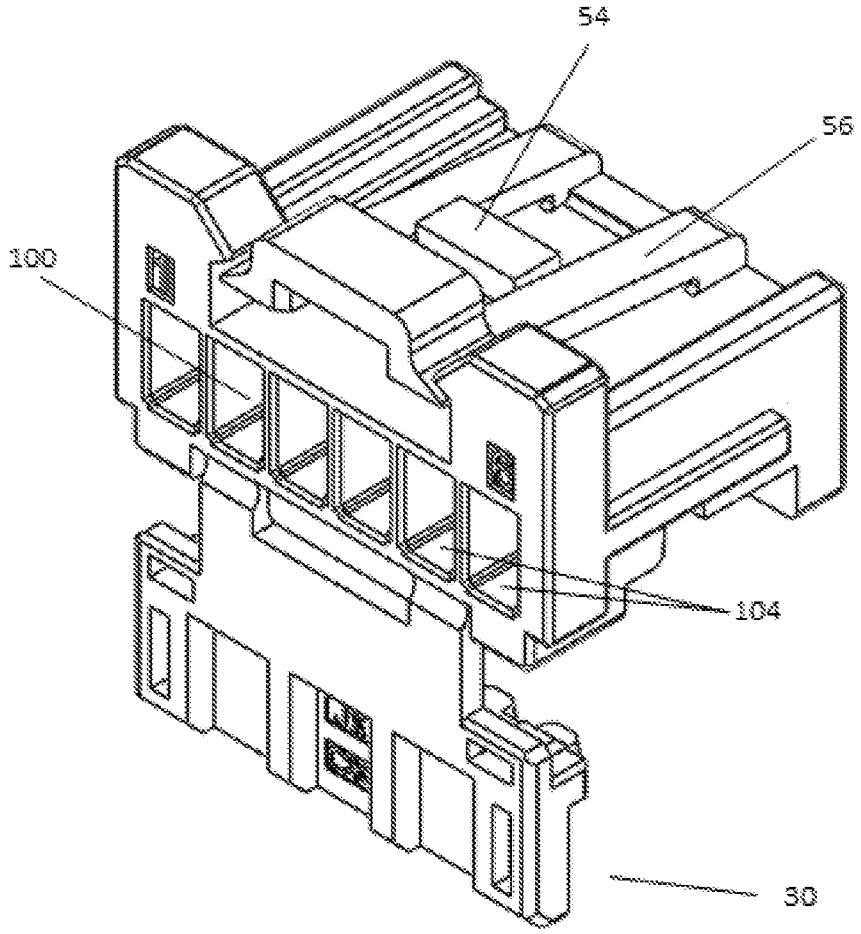
FIG. 12 is a perspective view of the female connector from the rear side with a terminal position assurance attached to the bottom of the main body.
Figure 13:
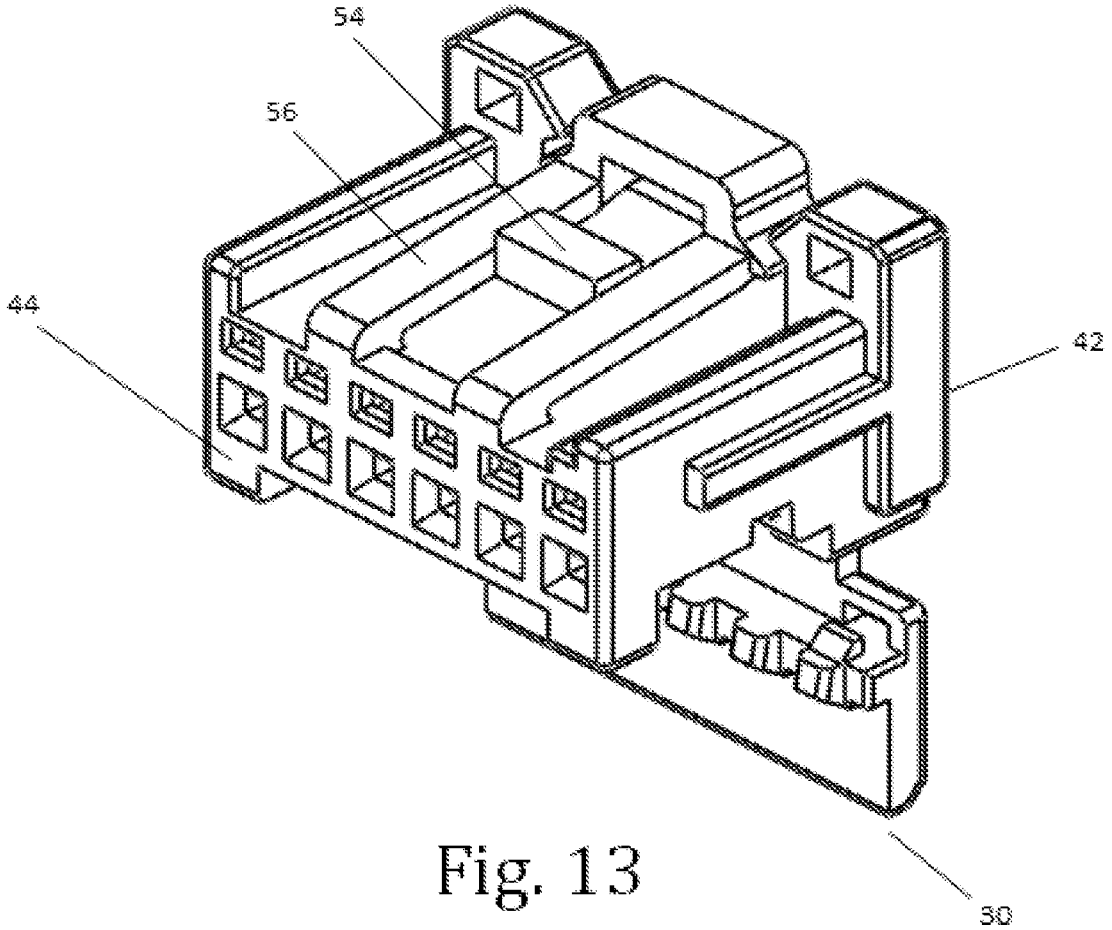
FIG. 13 is a perspective view of the female connector from the front side with a terminal position assurance attached to the bottom of the main body.

The present invention offers an improved terminal position assurance (TPA) mechanism. The connector system according to one embodiment of the present invention is illustrated as one of the components in FIG. 11*b*, comprising a main body 80 and a terminal position assurance 30. The rear of female connector 42 has one or more recesses for receiving wire terminal 3 that contains a terminal main body 9, shown in FIG. 11*a*. Male pins 161 shown in FIG. 11*e* connect through the side opposite to that of the female connector 2 insertion side.

One embodiment of the invention is a particular variant with six wires (six-pin) 7. The main body of the connector system according to the present invention may comprise a latch lock 54, latch beam 56, terminal cavities 100, and a bottom terminal cavity wall 104. The TPA 30 of the present invention may also be utilized with a main body 80 that does not have the latch and latch lock 54 system described above. A TPA 30 connects to the main body 80 through at least one, but possibly more than one, TPA hinge 32. The illustrated variant depicts a live hinge with two attachment points. However, other embodiments of the present invention may comprise various types or arrangements of hinges. The invention is not constrained to the illustrated attachment points directly below the entrance to the terminal cavities 100.

Figure 14:
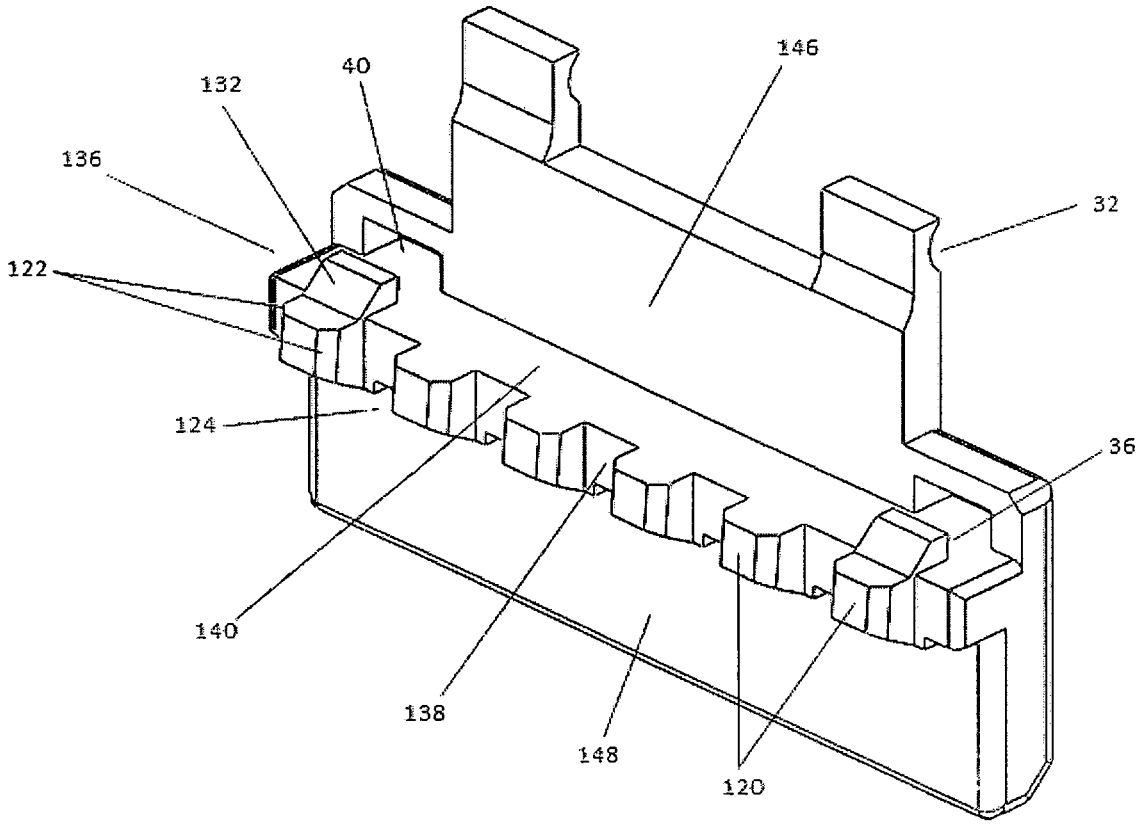
FIG. 14 is a perspective view of a terminal position assurance according to one embodiment of the present invention.

A TPA 30 according to an embodiment of the present invention is shown in FIG. 14. The TPA 30 comprises six portions: (1) TPA hinge 32, (2) TPA main body 146, (3) terminal blocking base 136, (4) terminal blocking feature 124, (5) TPA lock 36, and (6) terminal support surface 148. As illustrated in this embodiment, the terminal support surface 148 may be in-plane, or substantially in-plane with the bottom terminal cavity wall 104 when the TPA is fully engaged.

Figure 19:
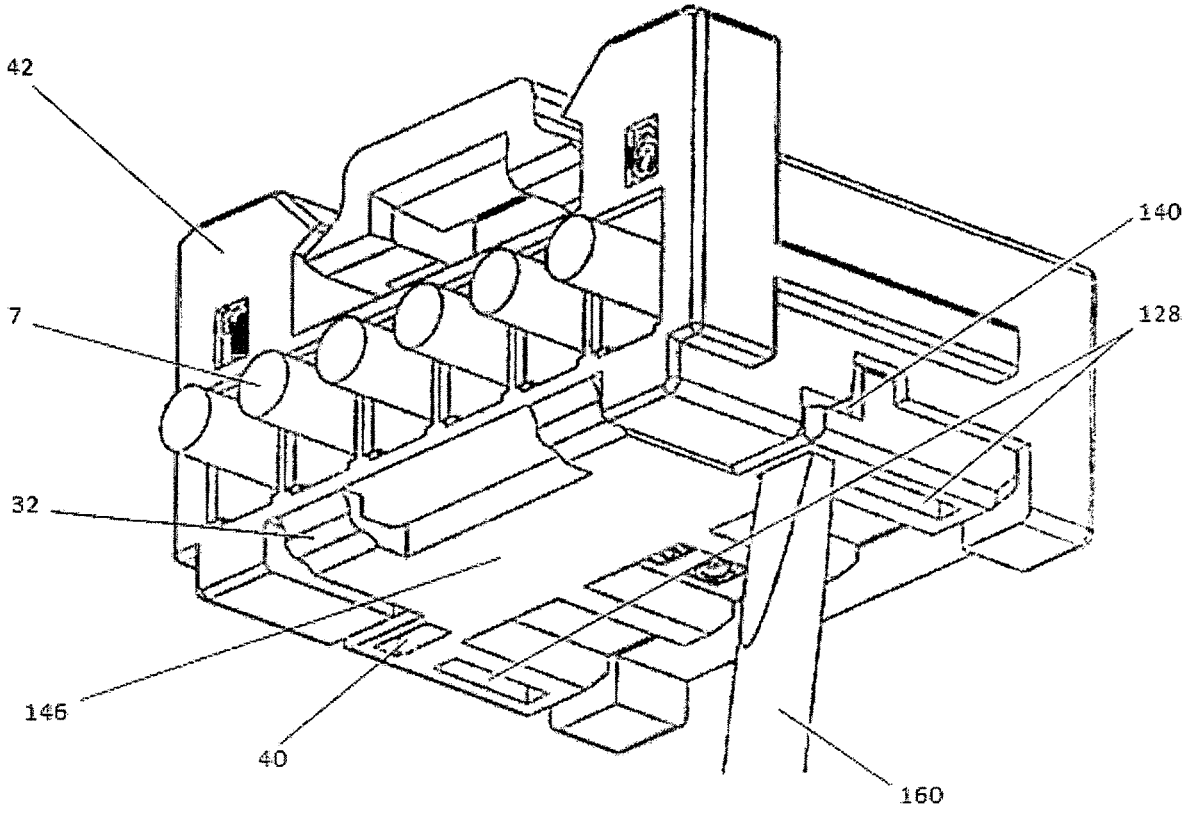
FIG. 19 is a perspective view of the connector and the engaged terminal position assurance with a servicing tool that allows the lock to disengage.

TPA main body 146 connects the hinge to other features of the TPA. It may also contain the location of servicing/forming holes 40. Servicing/forming holes 40 may facilitate manufacturing of the TPA lock 36, and serve as an access hole for servicing tool 160 to make contact with TPA locking retention contact surface 130 as shown in FIG. 19. A rotational upward force may cause the TPA locking retention contact surface to disengage from TPA lock contact surface 102 to completely disengage the TPA 30.

Figure 15:
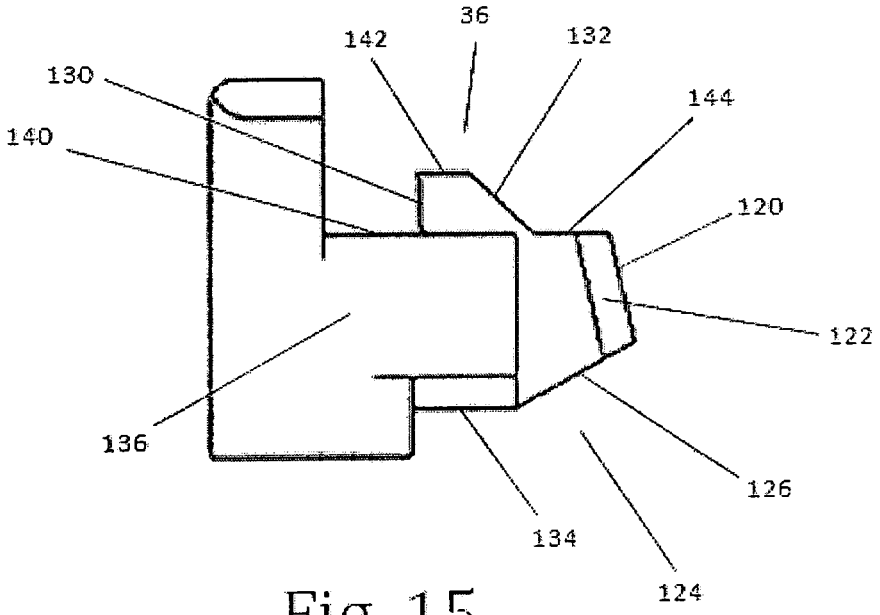
FIG. 15 is a side view of the "duck-head" shaped portion comprising TPA lock 36 and terminal blocking feature 124 of a terminal position assurance of a preferred embodiment of the present invention.

Together, the TPA lock 36 and terminal blocking feature 124 may comprise a feature approximately in the shape of a "duck-head." TPA lock 36 represents the "bill" and comprises three surfaces: (1) TPA locking insertion contact surface 132, (2) TPA locking offset surface 142 as shown in FIG. 15, and (3) TPA locking retention surface 130. In this particular embodiment, the TPA locking retention contact surface 130 is set at a slight back angle such that the angle between the TPA locking retention contact surface 130 and TPA locking offset surface 142 is acute. Other variations may have differing degrees of angle, but no larger than 90 degrees. TPA locking offset surface 142 may be substantially parallel to the terminal blocking base rear surface 140. TPA locking insertion contact surface 132 forms an obtuse angle with TPA locking offset surface 142. TPA locking insertion contact surface 132 angle may act as a guide when engaging TPA 30.

Terminal blocking feature 124 is shaped as the head portion of the "duck-head" shape and comprises additional terminal blocking offset surface 144, at least one TPA cavity guide 122, improper terminal detection surface 120, and TPA anti-stubbing feature 126. TPA cavity guides 122 are angled in between 30 and 60 degrees to serve as a guide feature should the operator close the TPA in a skewed direction. The improper terminal detection surface 120 forms an obtuse angle with the additional terminal blocking offset surface 144. More generally, this feature may also be referred to as a terminal blocking offset surface 144. The degree is such that when the TPA 30 contacts the terminal main body 9 a flush surface-to-surface contact is made as shown in FIG. 21*b*. TPA anti-stubbing feature 126 forms an obtuse angle with additional terminal blocking surface 134. The obtuse angle is designed such that it is able to catch the back side of terminal main body 9 as shown in FIG. 21*c*. In some embodiments of the present invention, the deepest angle without sacrificing integrity of strength due to material is preferable to allow increased room for error in installing wire 7. In this embodiment, six terminal blocking features 124 and two TPA locks 36 are shown in-line, with the TPA locks on either end. The number of blocking features may correspond to the number of wires. The present invention need not be limited to this particular arrangement or number of blocking features 124 or TPA locks 36. In particular, the TPA lock 36 does not necessarily need to be located outside of terminal blocking features 124.

Terminal blocking base 136 comprises a transverse upraised portion that projects upward from the TPA main body surface In this particular embodiment, the terminal blocking features 124 project from the terminal blocking base top surface 138, and the TPA locks 36 project from the terminal blocking base rear surface 140. As shown in FIG. 14, terminal blocking base 136 comprises a terminal blocking base top surface 138 (which includes the surfaces shown in between each terminal blocking feature 124), a terminal blocking base rear surface 140, and at least one additional terminal blocking surface 134. The terminal blocking base 136 may function to improve the structural integrity of the TPA 30.

Figure 16:
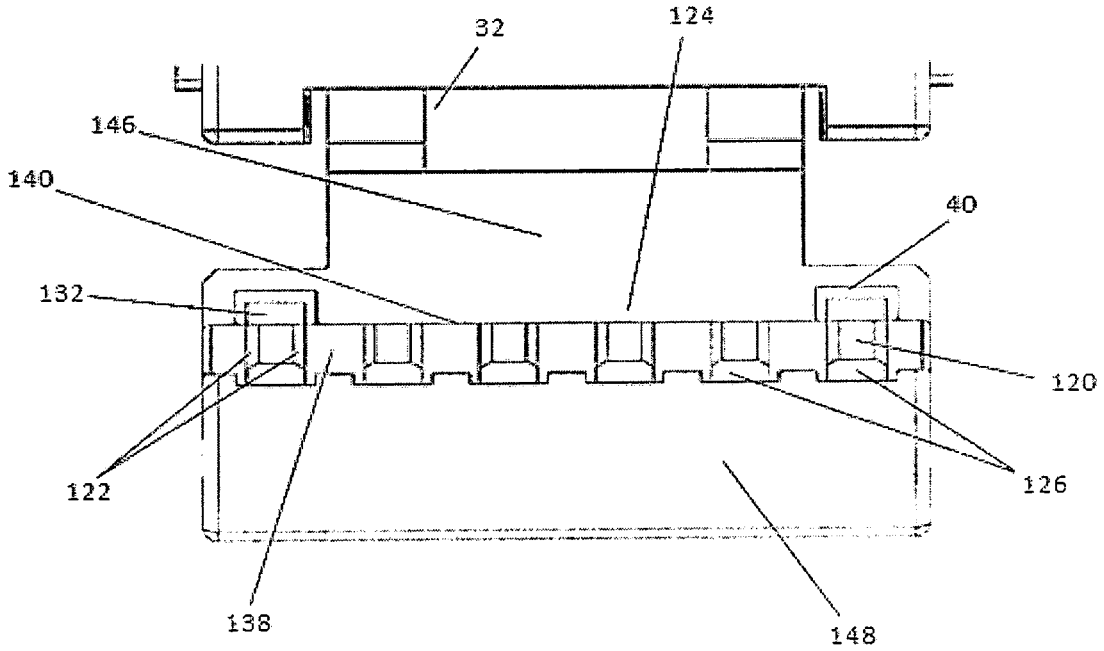
FIG. 16 is a front view of a terminal position assurance connected to the main body.

FIG. 16 is a front view of TPA 30 with the TPA hinge 32 connecting TPA to the main body 80. Terminal blocking feature 124 is shown which comprises TPA cavity guides 122, improper terminal detection surface 120, TPA anti-stubbing feature 126, and additional terminal blocking offset surface 144. TPA locking insertion contact surface 132 of the TPA lock 36 is shown from the front in FIG. 16 while TPA locking retention contact surface 130 is shown from the rear view in FIG. 17 through the servicing/forming holes 40. The improper terminal detection surface 120 may share two edges with TPA cavity guides 122, one edge with TPA anti-stubbing feature 126, and one edge with additional terminal blocking offset surface 144. Terminal blocking base top surface 138 may be parallel, or substantially parallel, to the terminal support surface 148. In this particular embodiment, terminal blocking base rear surface 140 is normal, or substantially normal, to the TPA main body 146 and is the surface from which TPA lock 36 projects.

Figure 17:
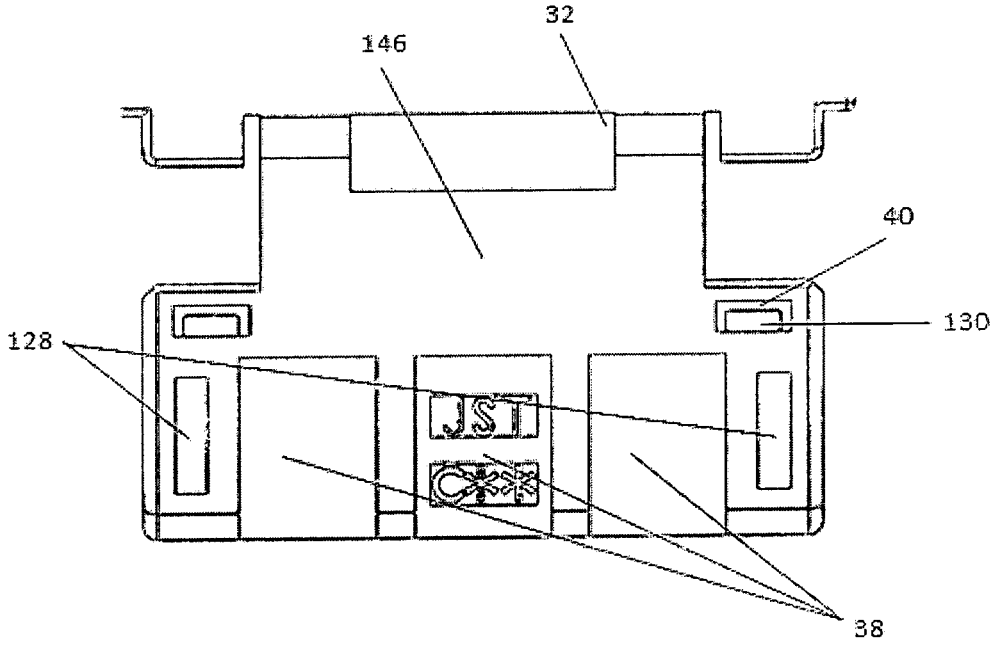
FIG. 17 is a rear view of a terminal position assurance connected to the main body when the TPA is in an unengaged position.

The rear view of the TPA 30 in FIG. 17 shows two additional features: void cores 128 and anti-scooping feature 38. Void cores may be material saving features, or features employed in manufacturing to facilitate injection molding, for example by helping maintain uniform wall thickness.

Figure 18A:
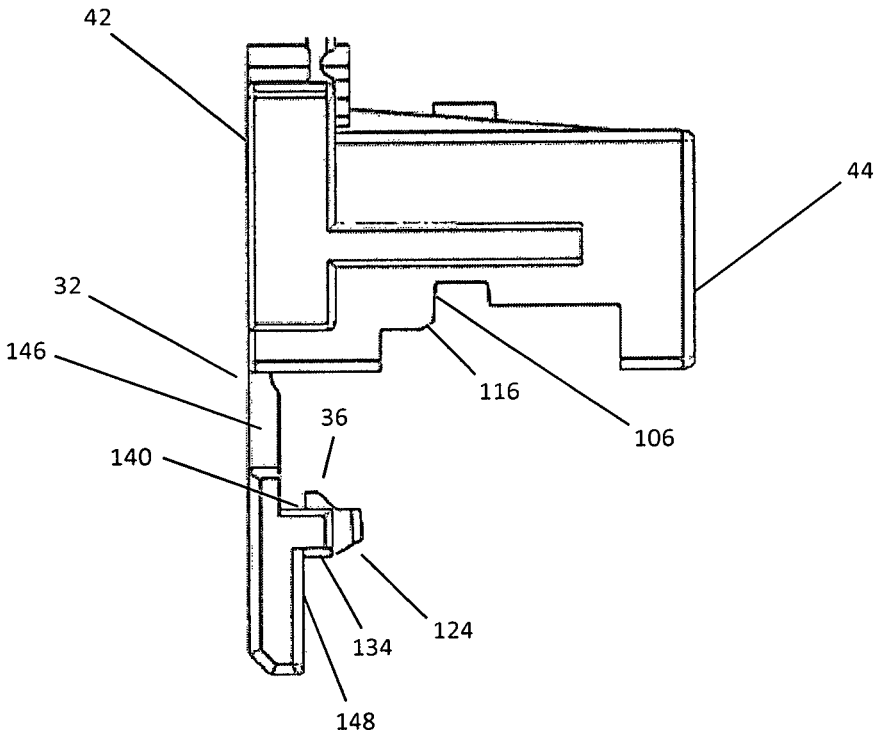
FIGS. 18*a* and 18*b* are side views of the connector and terminal position assurance of an embodiment of the present invention before and after engaging with a surface of the main body.
Figure 18B:
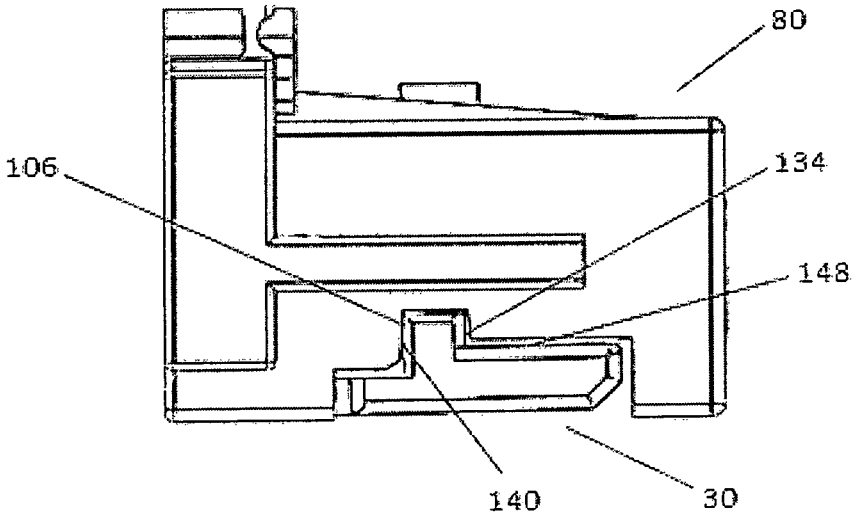

FIGS. 18*a* and 18*b* are side views of the TPA 30 and main body 80, of a disengaged and engaged TPA lock 36, respectively. Illustrated is the rear of female connector 42 and front of female connector 44. In this specific embodiment, the TPA hinge 32 is located in the bottom left of the main body. The TPA main body 146 connects the hinge to the TPA lock 36, terminal blocking feature 124, and terminal support surface 148. The terminal blocking base rear surface 140 and additional terminal blocking surface 134 form part of the terminal blocking base 136.

TPA engagement guide 116 is a non-sharp corner surface that makes contact with TPA locking insertion contact surface 132 during the engagement process. TPA engagement guide 116 can be a fillet or chamfer edge, and may serve to minimize the likelihood of shearing. TPA locking insertion contact surface 132 generates reaction force during TPA lock 36 engagement until enough force has been applied by an operator to surpass interaction between TPA locking insertion contact surface 132 and TPA engagement guide 116.

Connector blocking surface 106 may be substantially parallel to terminal blocking base rear surface 140 when TPA is fully engaged. When the wire terminal 3 is fully installed, connector blocking surface 106 may make flush contact with terminal blocking base rear surface 140 if the operator attempts to pull out the wire terminal 3, generating a reaction force that serves to ensure retention of the wire terminal. Terminal support surface 148 illustrated in FIG. 18*b* may be in-plane, or substantially in-plane with the bottom terminal cavity wall 104.

FIG. 19 is a perspective view of a TPA 30 fully installed with wires 7. The main body 80 is connected to the TPA main body 146 at TPA hinge 32. The servicing/forming holes 40 allow servicing tool 160 to make contact with TPA locking retention contact surface 130. An applied upwards rotational force may be applied to disengage the TPA lock. In this particular embodiment, void cores 128 are on the outer edges of the TPA's bottom side. Terminal blocking base rear surface 140 may contact the main body 80 if operator attempts to pull out wire 7.

Figure 20:
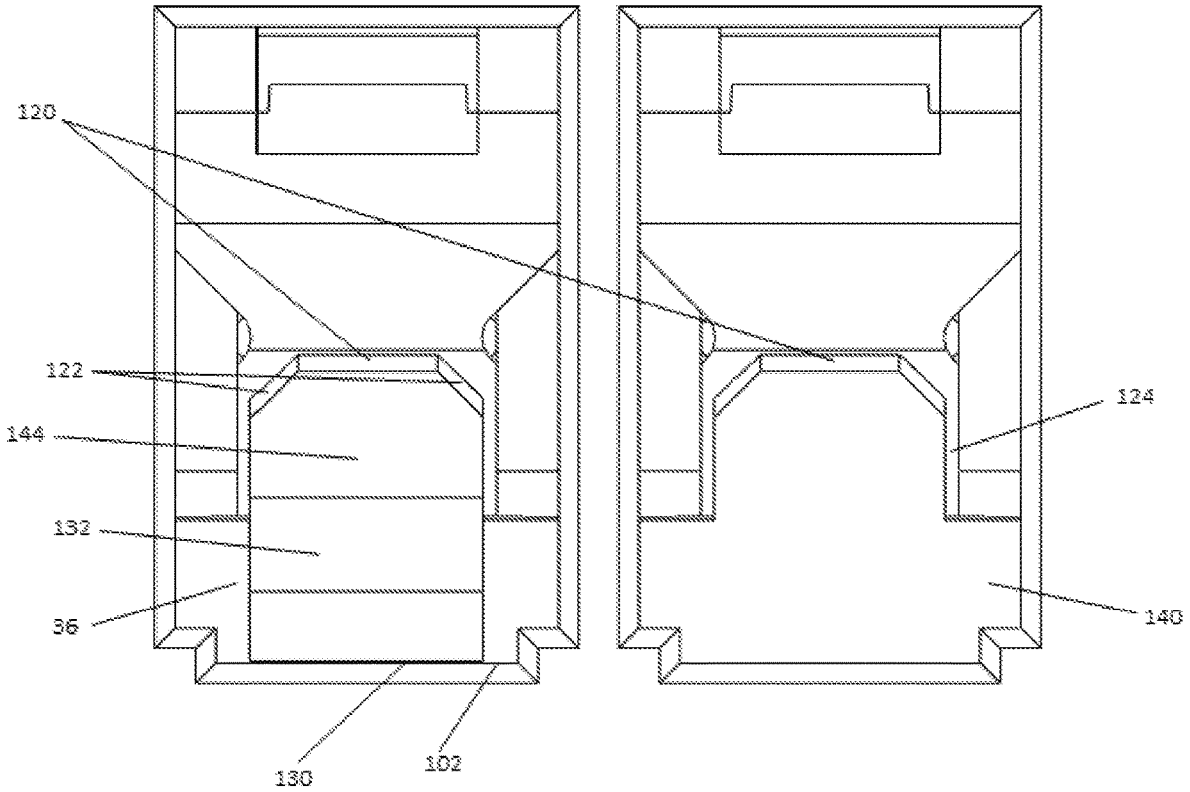
FIG. 20 is a rear view of a portion of the connector as viewed axially down two terminal cavities with the engaged terminal position assurance.

FIG. 20 is a close-up, rear view of the female connector 2. The viewer is looking along the longitudinal direction down the length of the terminal cavities 100 which do not have wire terminals 3 in this view, but the TPA 30 is fully engaged. This particular embodiment depicts one terminal blocking feature 124 with a TPA lock 36 on the left and a terminal blocking feature 124 on the right. Terminal blocking base rear surface 140 (which is a part of the terminal blocking base 136 in this embodiment) extends across both terminal cavities 100 and is below terminal blocking features 124. In this particular embodiment, the TPA lock 36 projects from the terminal blocking base rear surface 140 on the left terminal cavity 100. The terminal blocking features 124 illustrated are a subset of the ones from FIGS. 14 and 15. Illustrated are the improper terminal detection surfaces 120, TPA cavity guides 122, additional terminal blocking offset surface 144, TPA locking insertion contact surface 132, and TPA locking retention contact surface 130. The angles between the aforementioned surfaces of this particular embodiment can be more clearly seen in FIGS. 14 and 15. The last two surfaces (TPA locking retention contact surface 130 and TPA locking insertion contact surface 132) may form part of the TPA lock 36. This illustration also shows full contact between TPA locking retention surface 130 and TPA lock contact surface 102 when the TPA is fully engaged. TPA lock contact surface 102 may be a portion of the bottom terminal cavity wall 104.

Figure 21A:
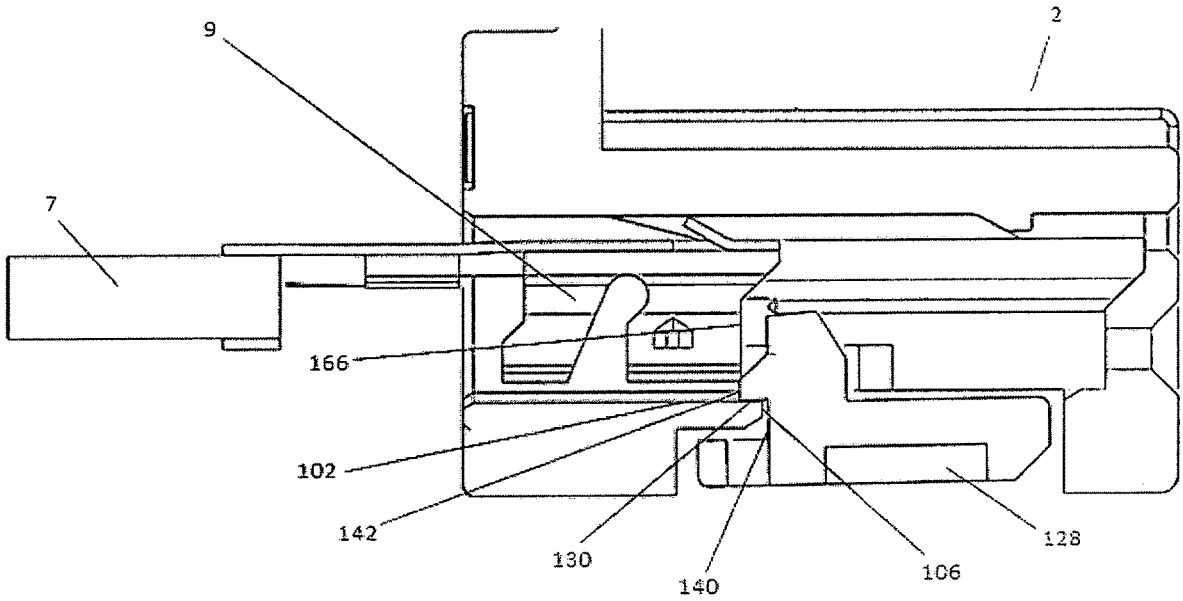
FIGS. 21*a*, 21*b*, 21*c*, and 21*d* are longitudinal sectional views of the connector, wire terminal, and terminal position assurance: engaged without the wire terminal, just before engaging, during engaging, and fully engaged.
Figure 21B:
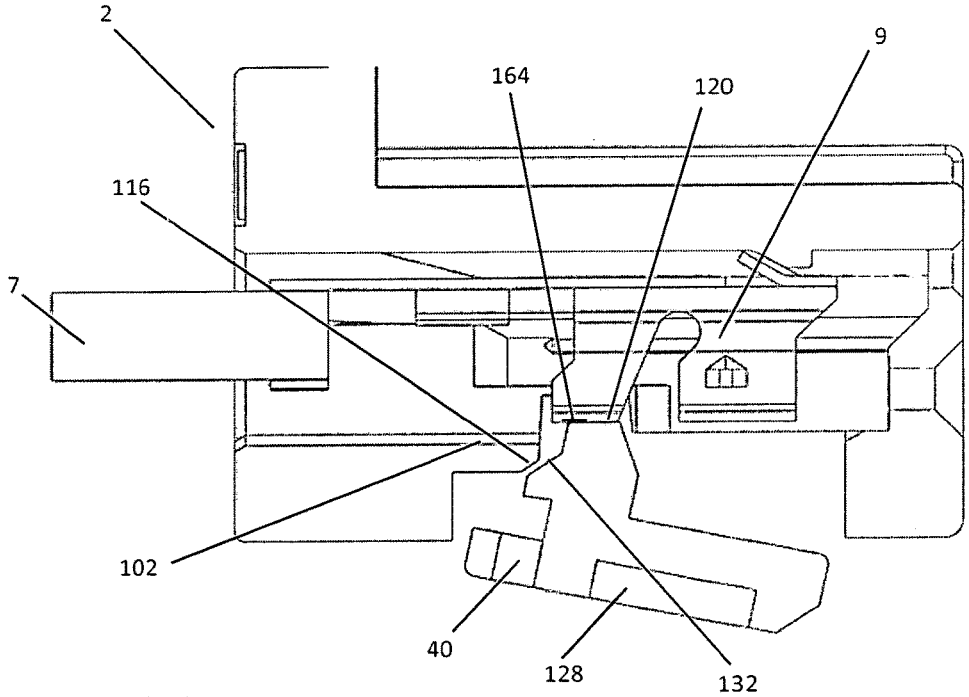
Figure 21C:
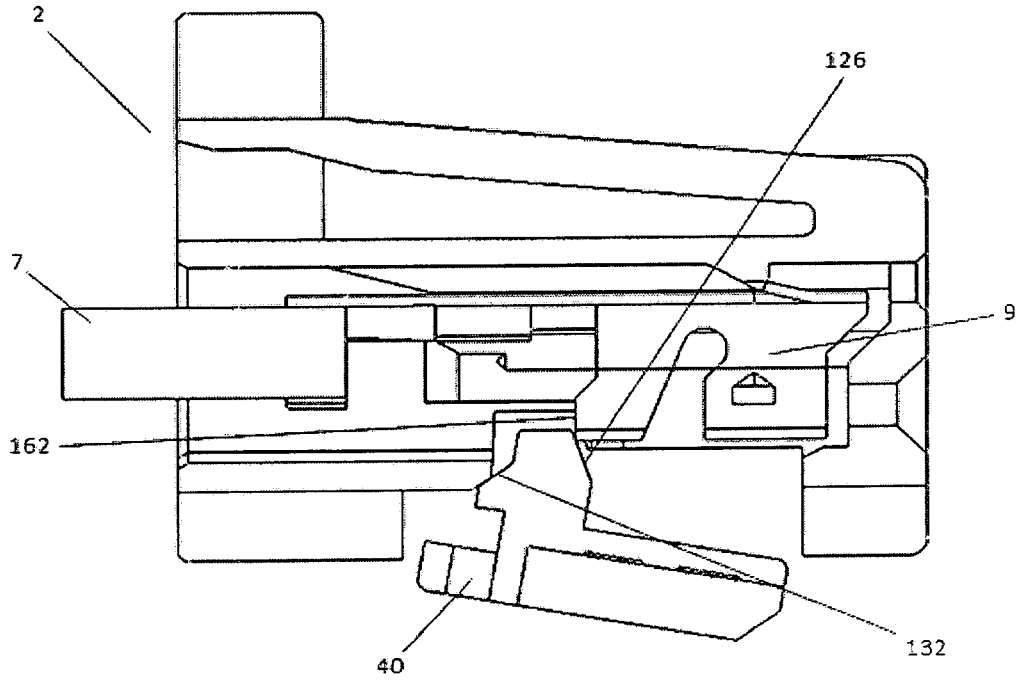

FIGS. 21*a*, 21*b*, 21*c*, and 21*d* are longitudinal sectional views of the TPA engagement process relative to the location of wire 7. In FIG. 21*a*, the TPA 30 is fully engaged without the wire terminal, and prevents improper installation by having TPA locking offset surface 142 contact terminal main body front contact surface 166. This prevents terminal main body 9 from further traveling into the terminal cavity 100. The TPA remains fully engaged through TPA locking retention contact surface 130 contacting TPA lock contact surface 102. In this particular embodiment there is a back angle in TPA locking retention contact surface in order to improve lock holding performance. The shown angle does not constrain the present invention as it may be designed at a variety of angles, including horizontal.

Connector blocking surface 106 does not contact terminal blocking base rear surface 140 when the wire 7 is pushing the TPA lock 36 into the terminal cavity 100.

FIG. 21*b* depicts the improper terminal detection surface 120 contacting terminal main body bottom surface 164 when an operator attempts to prematurely install the TPA 30. The angled surface of the improper terminal detection surface 120 allows a surface-to-surface contact with the terminal main body 9 in order to prevent deformation, for example on the top of the TPA blocking feature 124. A surface-to-surface contact according to this embodiment of the present invention provides a harder stop as compared to various surface-to-point or surface-to-edge contacts. The embodiment shown characterizes the angle of the improper terminal detection surface 120 such that the improper terminal detection surface 120 makes a flush contact with terminal main body bottom surface 164. There may be variations of the angle due to factors such as distance to TPA hinge 32 and height of the terminal blocking feature 124.

Also shown are the TPA engagement guide 116 that may contact TPA locking insertion contact surface 132. TPA lock contact surface 102, servicing/forming holes 40, void core 128, female connector 2 are illustrated.

FIG. 21*c* illustrates TPA engagement when the wire terminal is almost fully installed. The obtuse angle of the anti-stubbing feature 126 with respect to the additional terminal blocking surface 134 allows a room for error in wire 7 installation. When the anti-stubbing feature 126 contacts terminal main body rear surface 162, a reaction force helps drive the wire 7 fully into the terminal cavity. The obtuse angle is designed such that it is able to catch the back side of the terminal main body 9. In some embodiments of the present invention, the deepest angle without sacrificing integrity of strength due to material amount is preferable to allow increased room for error in installing wire 7. During the installation process, TPA locking insertion contact surface 132 may contact TPA engagement guide 116.

Figure 21D:
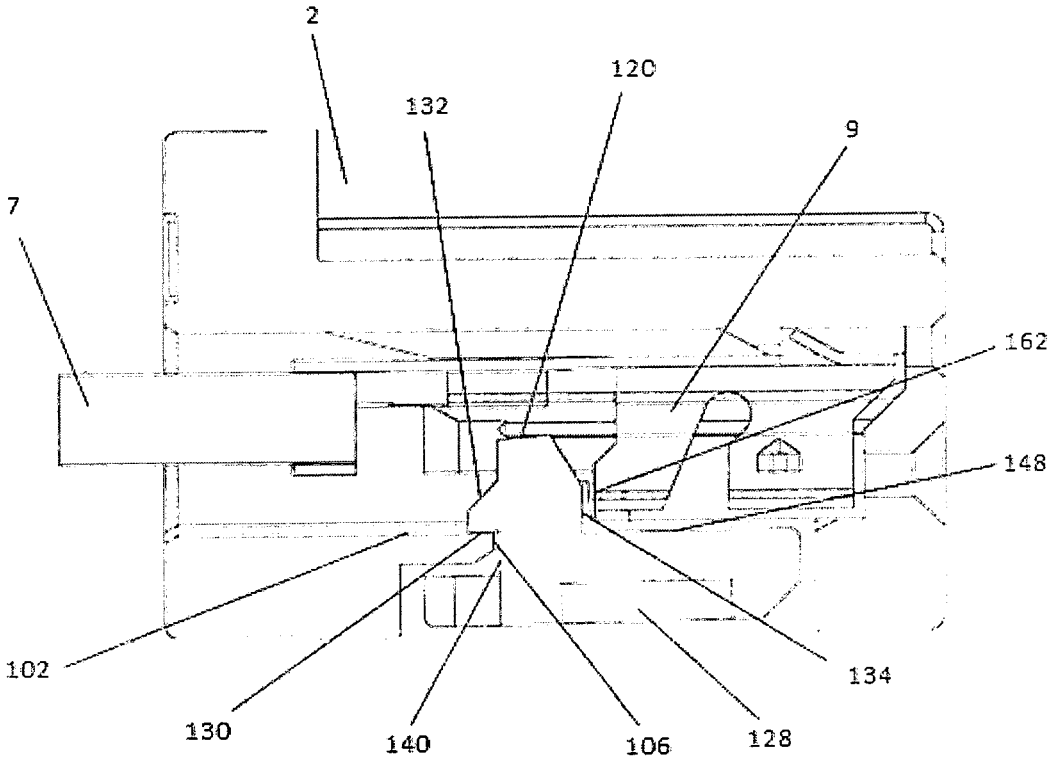

FIG. 21*d* illustrates TPA fully properly engaged with fully installed wire 7. TPA locking retention contact surface 130 makes contact with TPA lock contact surface 102 of the main body 80. If the operator attempts to pull wire 7 out of the female connector 2, terminal main body rear surface 162 will contact additional terminal blocking surface 134. Terminal blocking base 140 could also contact connector blocking surface 106. Both of these surface-to-surface contacts provide sufficient reaction forces to prevent wire terminal disengagement. Furthermore, a torque applied to wire 7 could cause terminal main body 9 to contact anti-stubbing feature 126, which would also prevent wire terminal disengagement. Terminal support surface 134 is located on the bottom terminal cavity wall 104 and may be in line with TPA lock contact surface 102. While in its proper state, terminal main body 9 may not contact terminal support surface 148, the two may contact during an imperfect wire terminal installation. In this embodiment of the present invention, improper terminal detection surface 120 does not contact wire terminal 3 when TPA 30 is fully installed.

Figure 22:
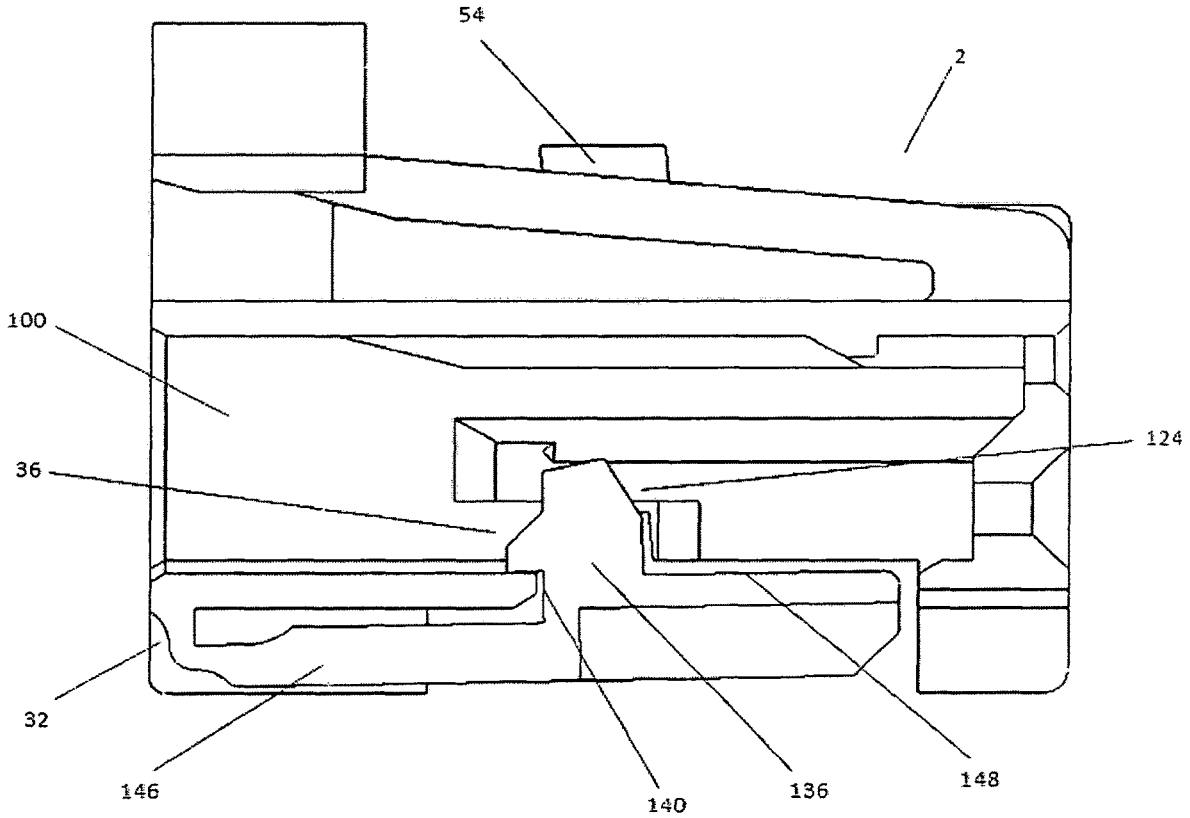
FIG. 22 is a longitudinal sectional view of the connector with terminal position assurance fully engaged.

FIG. 22 depicts a sectional view such that the TPA hinge 32 and TPA main body 146 are shown connecting TPA 30 to the main body 80. The TPA is fully installed with the TPA lock 36 contacting the TPA lock contact surface 102 as shown in FIG. 21*d*. Terminal blocking feature 124 projects from the terminal blocking base 136 in this embodiment. Terminal support surface 148 may be substantially in-plane with TPA lock contact surface 102. In this view, terminal cavity 100 is empty as a wire terminal is not shown in this view.

Figure 23:
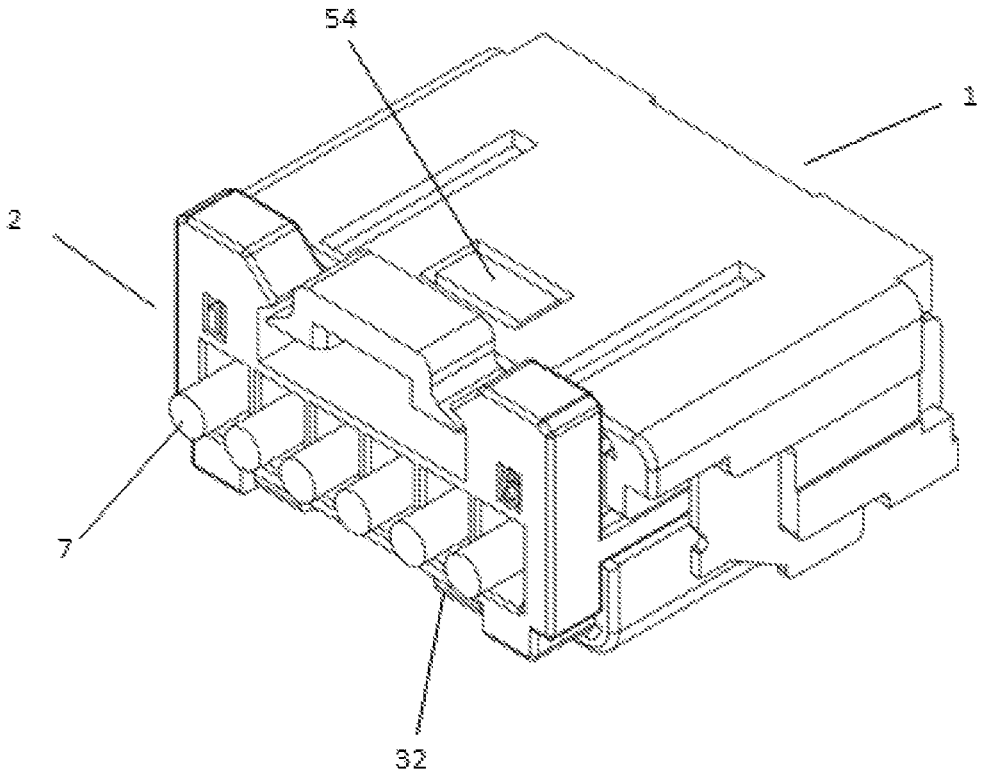
FIG. 23 is a perspective view of the female connector with terminal position assurance fully engaged, mated with the male connector.

FIG. 23 is a perspective view of wire 7, main body 80, TPA 30, and male connector 1 fully installed. The TPA is installed after at least a partial installation of wire 7. The female connector 2 mates into male connector 1 and engages through the latch lock 54. This particular embodiment of female and male connector engagement is not unique to the TPA 30, and other embodiments may be used according to the novel TPA of the present invention.

The many features and advantages of the present invention are apparent from the written description and, thus, it is intended by the appended claims to cover all such features and advantages of the invention. Further, since numerous modifications and changes will readily occur to those skilled in the art, it is not desired to limit the invention to the exact construction and operation as illustrated and described. Hence, all suitable modifications and equivalents may be included as falling within the scope of the invention.

An example of the present invention is a connector terminal position assurance comprising:

(a) a terminal position assurance ("TPA") lock comprising:

a TPA locking insertion contact surface; and a TPA locking offset surface; and (b) a terminal blocking feature comprising:

a TPA cavity guide; an improper terminal detection surface; and a TPA anti-stubbing feature.

The above described connector terminal position assurance may further comprise: a TPA locking retention contact surface; and an additional terminal blocking offset surface disposed on the terminal blocking feature.

Further, the above described connector terminal position assurance may feature the TPA locking retention contact surface wherein it is substantially orthogonal to the TPA locking offset surface.

Still further, the above described connector terminal position assurance may feature the TPA locking retention contact surface wherein it is at an angle slightly acute to the TPA locking offset surface.

The above described connector terminal position assurance may further comprise at least one TPA cavity guide disposed adjacent to the improper terminal detection surface.

The above described connector terminal position assurance may further comprise a terminal blocking feature extending from a terminal blocking base; such that the TPA lock projects substantially orthogonally from the terminal blocking feature; and an additional terminal blocking offset surface is disposed on the terminal blocking feature opposite to the TPA lock.

The above described connector terminal position assurance may further comprise the TPA locking retention contact surface disposed on a surface of the terminal blocking base; the TPA locking offset surface disposed on the TPA lock and substantially parallel to the surface of the terminal blocking base; the TPA locking insertion contact surface disposed between the TPA locking offset surface and an additional terminal blocking offset surface disposed on the terminal blocking feature; and the improper terminal detection surface disposed between the additional terminal blocking offset surface and the TPA anti-stubbing feature.

The above described connector terminal position assurance may further comprise the improper terminal detection surface angled such that if a terminal is not fully engaged, and the improper terminal detection surface contacts a surface of the terminal, the improper detection surface is flush with the surface of the terminal.

The above described connector terminal position assurance of may further comprise a TPA main body connected to a main body of a connector by a hinge, wherein a terminal blocking base is disposed on the TPA main body, and a TPA lock is disposed on the terminal blocking base.

The above described connector terminal position assurance may be attached to a main body of a connector, the connector comprising: a connector housing, a latch stop mechanism adjoining the connector housing, and a latch adjoining the connector housing; the latch stop mechanism comprising a proximal hinge, a distal hinge, a proximal section between the proximal hinge and the distal hinge, a distal section situated on a side of the distal hinge opposite the proximal section, and a latch stop disposed on the distal section; and the latch comprising a latch stop contact surface whereby when the latch stop contact surface contacts the latch stop, movement of the latch is limited.

Alternatively, an embodiment of a connector terminal position assurance according to the present invention may comprise a terminal position assurance ("TPA") terminal blocking feature comprising:

(a) a terminal blocking base disposed on a portion of the TPA, the terminal blocking base having a rear surface and a top surface;

(b) an improper terminal detection surface substantially orthogonal to the terminal blocking base rear surface; and (c) a TPA cavity guide disposed on a side of the improper terminal detection surface.

The above described connector terminal position assurance of may further comprise a TPA anti-stubbing feature, and wherein the improper terminal detection surface has a front, a rear, and two sides, with the rear of the terminal detection surface adjoining the terminal blocking base rear surface, and wherein each side of the improper terminal detection surface adjoins a TPA cavity guide angled at between 30 and 60 degrees with the terminal blocking base top surface.

The above described connector terminal position assurance of may further comprise multiple terminal blocking features, each projecting from the terminal blocking base in a line across the width of the TPA, and wherein a TPA cavity guide is disposed on more than one side of the improper terminal detection surface.

The above described connector terminal position assurance of may further comprise a TPA main body connected to a main body of a connector by a hinge, wherein the terminal blocking base is disposed on the TPA main body, and a TPA lock is disposed on the terminal blocking base.

Additionally, the present invention contemplates a method of assuring terminal position for a connector comprising:

(1) inserting a terminal into the opening of a terminal cavity;
(2) contacting a primary lock with a terminal tang;
(3) locking the primary lock;
(4) applying a force on a terminal position assurance ("TPA") such that the TPA having a TPA lock pivots around a hinge;
(5) contacting a TPA locking insertion contact surface with a TPA engagement guide;
(6) continuing to exert force on the TPA until a TPA locking surface on the TPA lock contacts a TPA lock contact surface located on a bottom terminal cavity wall.

These may be individual steps in order, steps not in a particular order, or not discrete steps but rather elements which when accomplished complete an object of the present invention.

Figure 24:
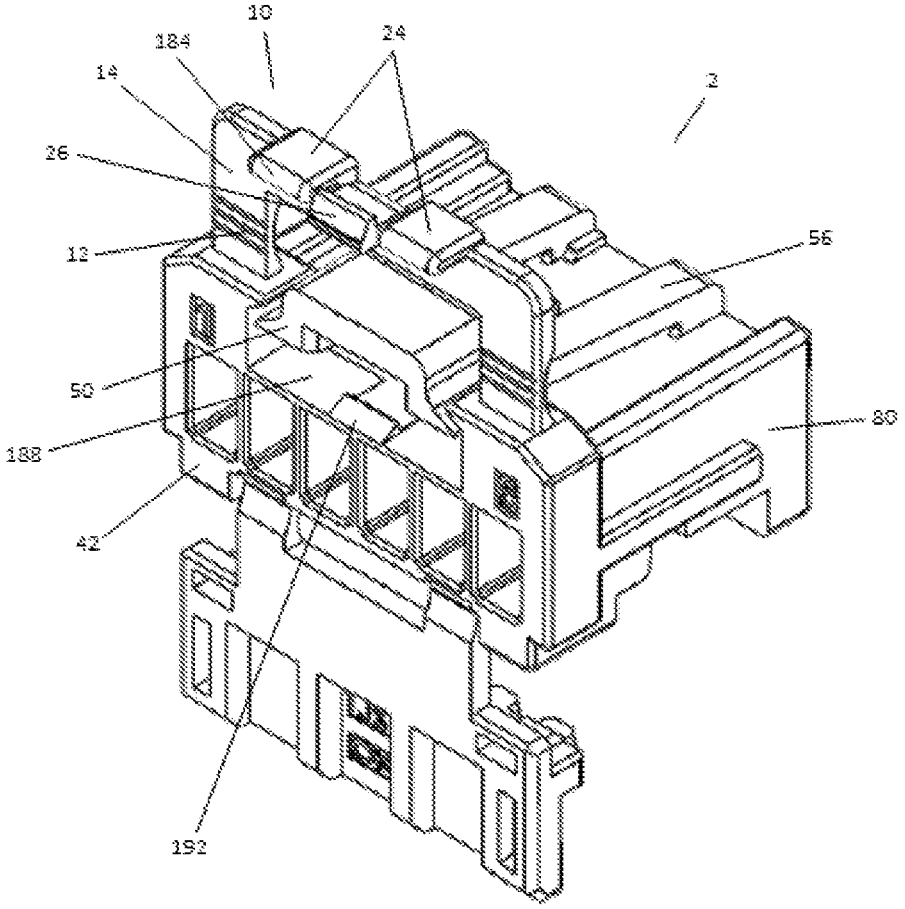
FIG. 24 is a perspective view of a female connector of the present invention with a latch stop mechanism from the rear side.

The present invention offers an improved connector position assurance (CPA) mechanism with a proximal hinge 12, or multiple hinges located close together in-line, such that a latch stop mechanism 10 may rotate approximately 180 degrees around a point of rotation. One embodiment of the present invention is illustrated in FIG. 24. Latch stop mechanism 10 comprises a proximal hinge 12, proximal section 14, latch stop lock arm 186, and wedge 24.

Proximal hinge 12 is preferably disposed on the top of the female connector housing 80, located at the top portion of female connector housing 80 towards the rear of female connector 42. A proximal hinge 12 connects proximal section 14 to female connector housing 80. In a preferred embodiment, proximal hinge 12 allows proximal section 14 to rotate 180 degrees around a point of rotation such that proximal section 14 may be oriented adjacent to the rear of female connector 42. Depending on where the base of proximal hinge 12 is attached to female connector housing 80, the rotational angle may be more or less. In a preferred embodiment, proximal hinge 12 is a live hinge.

Figure 27:
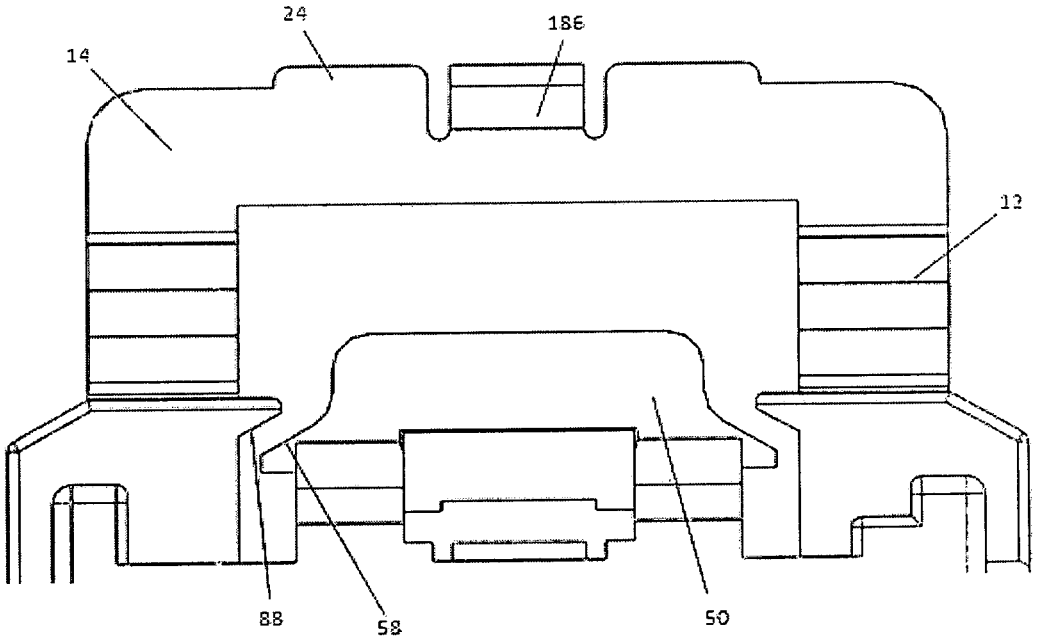
FIG. 27 is a front section view of the upper portion of a female connector of the present invention with a latch stop mechanism.

Proximal section 14 extends from proximal hinge 12 and serves as a base from which latch stop lock 26 may project. A proximal section 14 may be substantially planar, and preferably has a cut-out or opening to accommodate structures on the female connector housing 80 that would otherwise interfere with engaging the latch stop mechanism 10, as shown in FIG. 27. In this embodiment, proximal section 14 is attached to either side of the top of the connector housing by proximal hinges 12. The largest portion of the proximal section 14 in this embodiment is a transverse beam on which wedges 24 and latch stop lock arm 186 are disposed. Proximal section 14 may be created from a single piece of material with an absence of material between proximal hinges 12 located at either side of the top portion of the female connector housing 80.

In a preferred embodiment of the present invention, distal section 18, shown in in FIG. 3, is not required, and may be omitted, as shown FIG. 24, due to a modification in the hinge arrangement. Therefore, a proximal section does not imply that a distal section or any other section is required. Similarly, a proximal hinge does not imply that a distal hinge or any other hinge is required.

Figure 32:
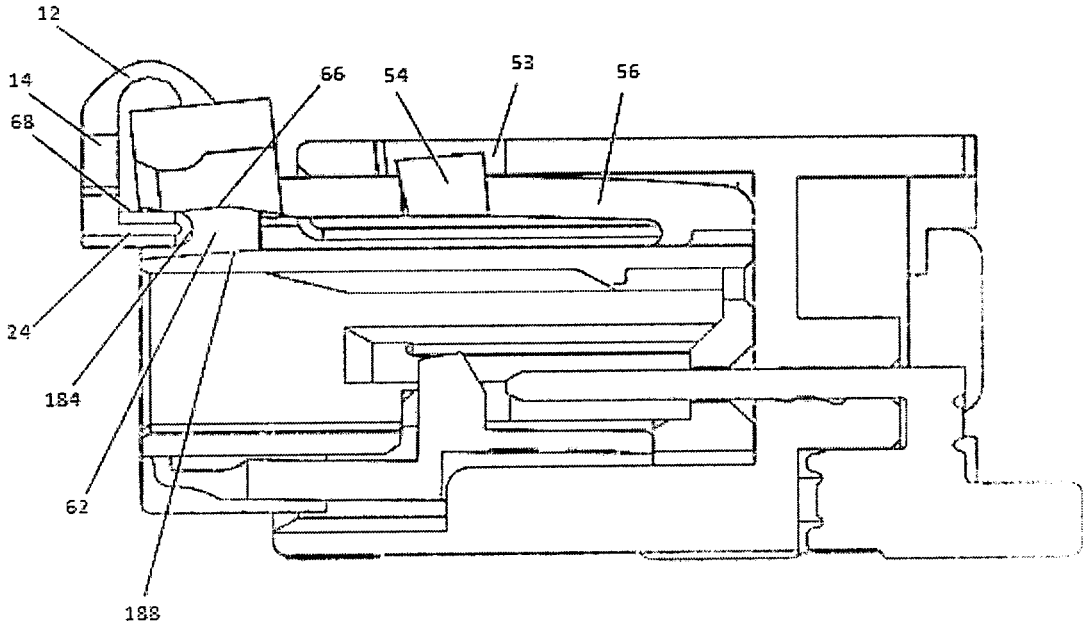
FIG. 32 is a longitudinal section view of female connector, male connector, and latch stop mechanism of the present invention after proper installation.
Figure 33:
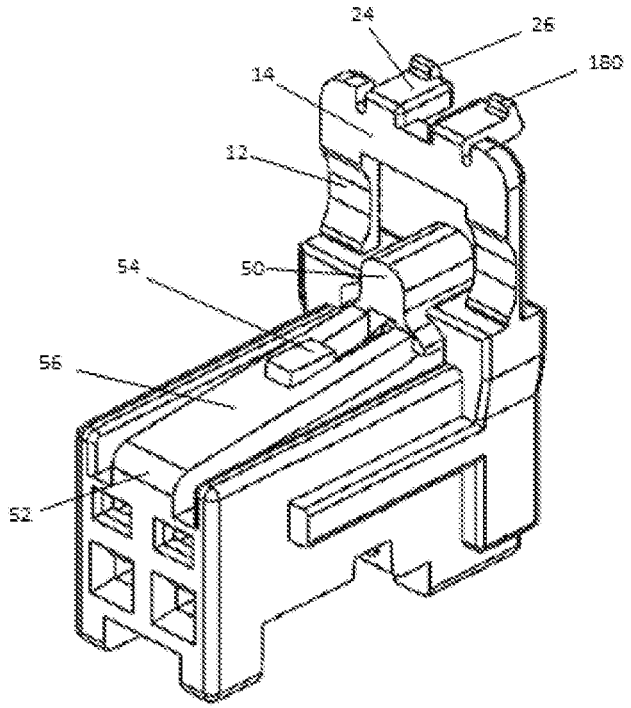
FIG. 33 is a perspective view of two-pin variant of the present invention from the front side of a female connector.
Figure 34:
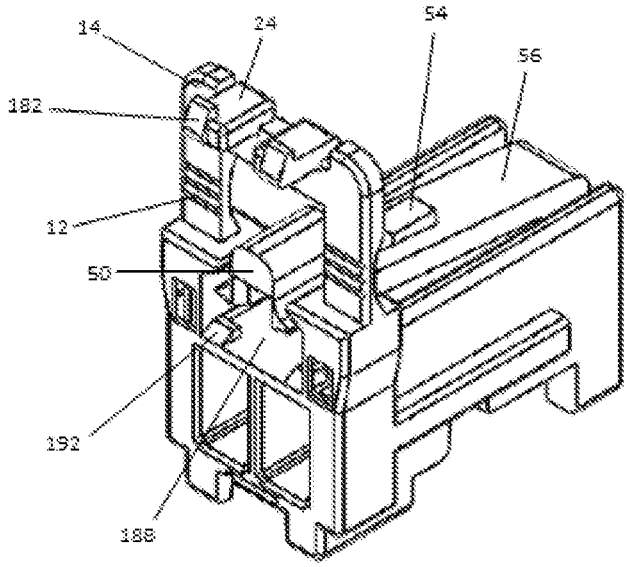
FIG. 34 is a perspective view of a two-pin variant of the present invention from the rear side of a female connector.

Wedge 24 may project from proximal section 14 at approximately a right angle from a location preferably at or nearly at the distal end of the proximal section 14. In an embodiment of the present invention, the wedge 24 may project from a different location than the latch stop lock arm 186, and may be a different structure than latch stop lock arm 186, as shown in FIG. 24. However, in another embodiment of the present invention, wedge 24 may be located on or be a part of latch stop lock arm 186 as shown in FIGS. 33 and 34. One function of wedge 24 is to prevent latch beam 56 from substantially deflecting as can be seen in FIG. 32. Wedge 24 may have a latch stop surface 68 that is flat and rectangular. Latch stop surface 68 may contact latch stop contact surface 66 when latch stop mechanism 10 is installed, as shown in FIG. 32. The wedge 24 may also serve to maintain a gap between latch stop contact surface 66 and latch stop interference surface 188. It is not a requirement of the present invention that wedge 24 comprise one or more inclined surfaces. Rather, wedge 24 may have at least two surfaces, such that one surface of the wedge 24 may contact latch stop contact surface 66 while a second surface of wedge 24 may contact latch stop interference surface 188. Two surfaces of wedge 24 are separated by a distance determined by the gap between latch stop contact surface 66 and latch stop interference surface 188 such that latch lock 54 remains in latch lock window 53 as shown in FIG. 32.

In FIG. 24, two wedges 24 are shown in an embodiment with wedge anti-stubbing features 184 that are semi-circle shaped protrusions. A wedge anti-stubbing feature 184 may be located on the portion of the wedge 24 opposite the location from which wedge 24 projects from proximal section 14. Other embodiments of the present invention may comprise a different number of wedges 24 as well as different shape profiles for wedge anti-stubbing feature 184. For example, a wedge with a fillet or chamfered anti-stubbing feature is also possible. A non-flat surface, such as a curved surface, of anti-stubbing feature 184 helps guide wedge 24 into latch cavity 62, especially if wedge anti-stubbing feature 184 improperly contacts a surface on the rear of female connector 42. The shape of wedge 24 in this embodiment is a rectangular prism with rounded edges. However, wedge 24 may also comprise a protrusion with a single inclined plane, or convex surface, or concave surface; or two inclined planes, convex surfaces, concave surfaces, or both a concave and a convex surface.

Figure 25:
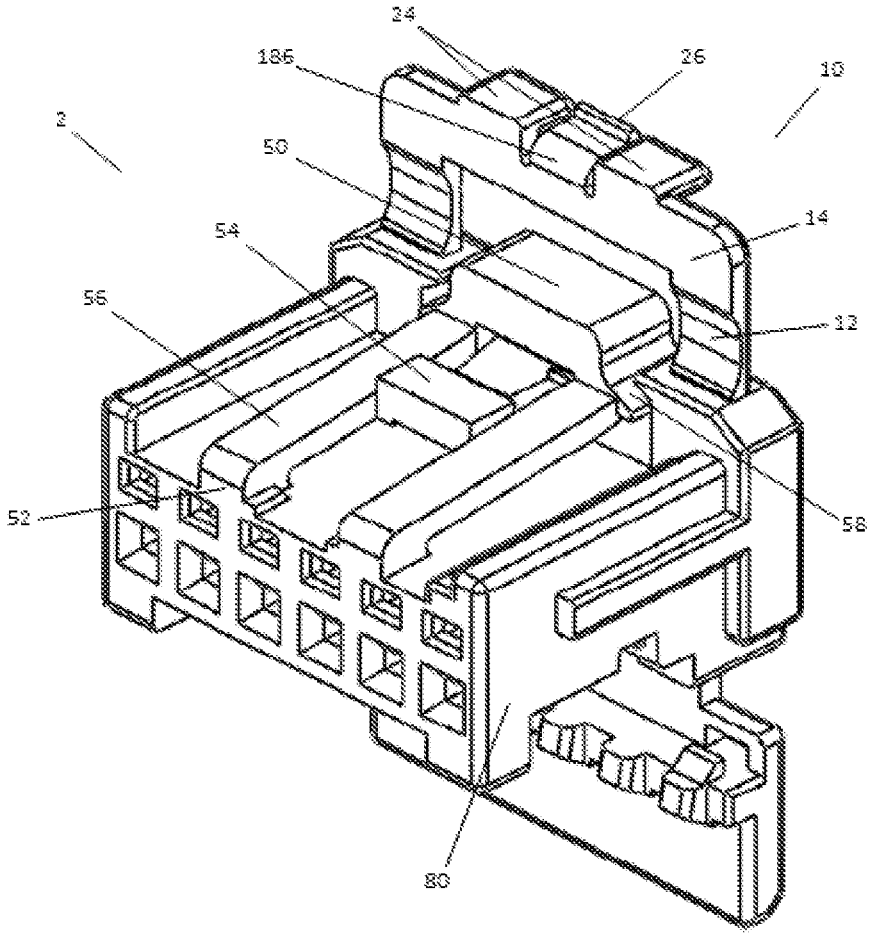
FIG. 25 is a perspective view of a female connector of the present invention with a latch stop mechanism from the front side.
Figure 26:
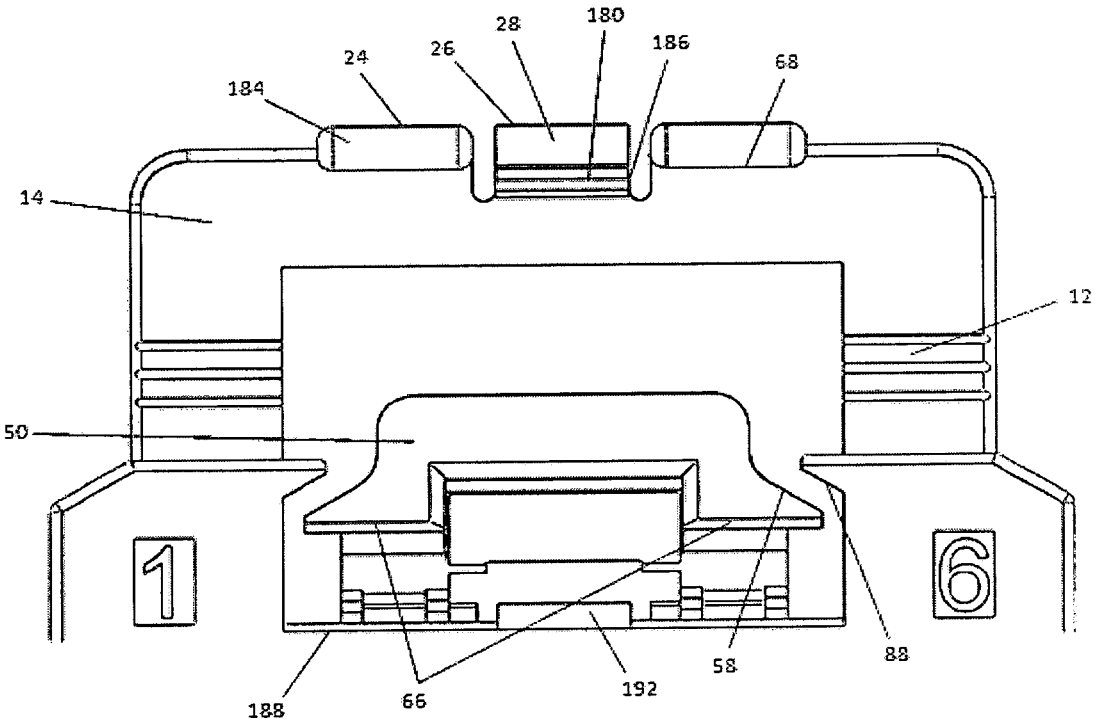
FIG. 26 is a rear view of top portion of a female connector of the present invention with a latch stop mechanism.

FIG. 25 shows latch stop lock 26 projecting from or nearly from the distal portion of proximal section 14. Latch stop lock 26 is located in between two wedges 24. In this embodiment, latch stop lock 26 is connected to proximal section 14 via latch stop lock arm 186 instead of latch stop arm 22 as shown in a different embodiment, FIG. 4. In a previous embodiment, latch stop arm 26 is connected to wedge 24 via latch stop arm 22. However, in this embodiment shown in FIGS. 26 and 27, latch stop lock arm 186 does not connect latch stop lock 26 to wedge 24. One function of latch stop lock arm 186 is to help engage latch stop lock 26 with latch stop catch 190. As shown in FIG. 26, the flexure surface 180 disposed on the inner surface of the curved portion of latch stop lock arm 186 allows latch stop lock arm 186 to slightly bend. A gap exists between wedges 24 and latch stop lock 26 in this variant to aid in slight deflection of latch stop lock arm 186 during engagement. It is possible to connect latch stop lock 26 and wedge 24, as shown in FIGS. 33 and 34, in a different embodiment. No gaps exist between wedge 24 and latch stop lock 26 in the variants shown in FIGS. 33 and 34.

Female connector 2 has latch beam 56 that is connected to female connector housing 80 via hinge 52. Thus, latch 50 and latch beam 56 adjoin female connector housing 80. The hinge allows latch beam 56 to move. Latch lock 54 and latch 50 are disposed on latch beam 56 and may move with the latch beam 56 relative to the hinge 52. In an alternative embodiment, a hinge is not required, for example, movement is accomplished by allowing latch beam 56 to deflect such that the latch lock 54 and latch 50 may move upward or downward. Movement of latch beam 56 is constrained in the upwards direction by latch overstress protection surface on female connector housing 88 as shown on FIG. 27. Latch overstress protection surface on latch 58 is disposed on the connector housing and positioned so that it corresponds with the latch overstress protection surface on female connector housing 88. Thus, when sufficient force is applied, the latch beam 56 along with latch lock 54 and latch 50 move upward until coming into contact with latch overstress protection surface on female connector housing 88, preventing further upward movement. In a preferred embodiment, there is a corresponding latch overstress protection surface on latch 58 for each latch overstress protection surface on female connector housing 88. In a preferred embodiment, there may be one or more sets of corresponding latch overstress protection surface on latch 58 and latch overstress protection surfaces on female connector housing 88.

As shown in FIG. 27, latch overstress protection surfaces on female connector housing 88 may be disposed on projections located on the upper portion of a female connector housing 80. More particularly, these projections may be located on opposing sides of the top portion of the female connector housing 80, with the projections facing inwards and overhanging the inside of the connector body. Preferably, the projections overhang above a latch cavity 62. Latch overstress protection surfaces on female connector housing 88 may be inclined surfaces located on the underside of overhanging projections from opposing sides of the top portion of the female connector housing 80.

Latch overstress protection surface on latch 58 may be located on projections from the latch 50. In FIG. 27, latch overstress protection surface on latch 58 are located on projections extending outward from the sides of the latch 50. These projections are situated beneath corresponding, overhanging projections from opposing sides of the top of the female connector housing 80, such that latch overstress protection surface on latch 58 face corresponding latch overstress protection surfaces on female connector housing 88. The space between latch overstress protection surface on latch 58 and corresponding latch overstress protection surfaces on female connector housing 88 are designed according to the present invention such that movement of the latch 50 and latch beam 56 are limited.

Figure 28:
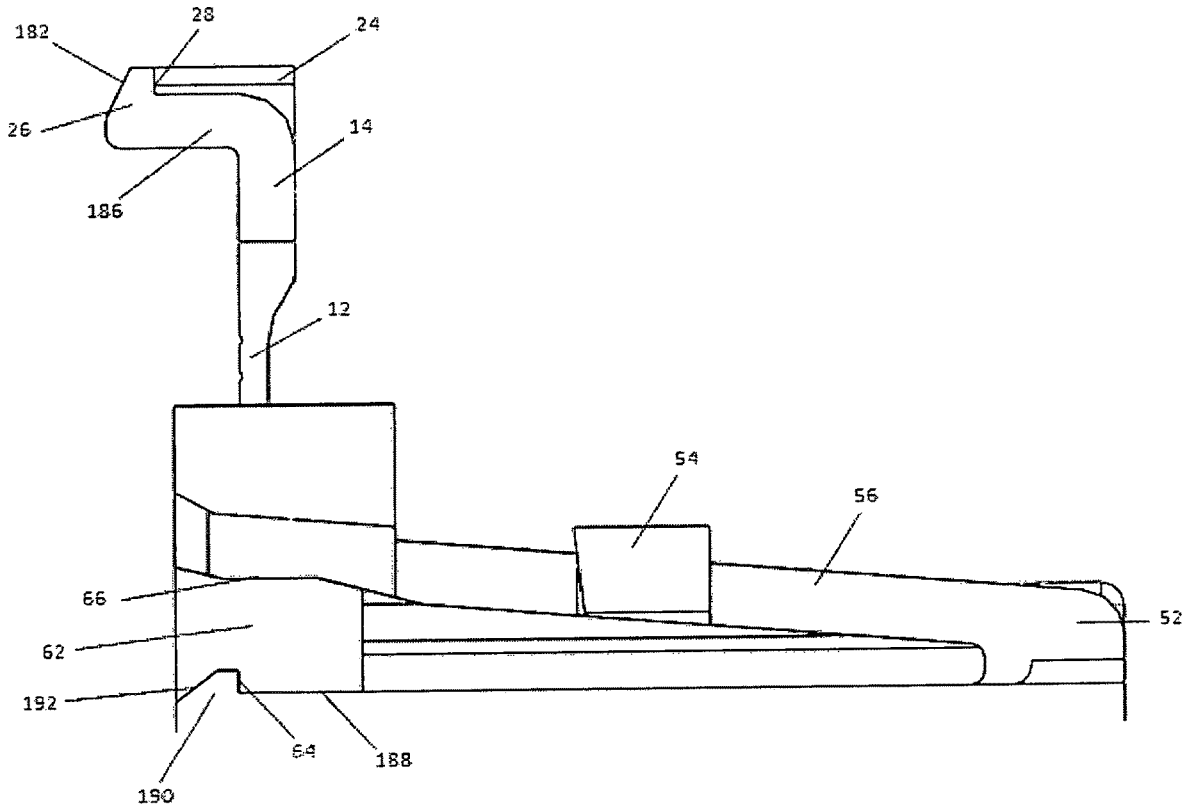
FIG. 28 is a longitudinal section view of the top portion of a female connector of the present invention with a latch stop mechanism.

Latch stop catch 190, as shown in FIG. 28, is disposed on latch interference surface 188 of female connector 2 at or near the rear of female connector 42. Latch stop catch 190 comprise a latch stop catch incline surface 192 projecting upward from latch interference surface 188, a flat horizontal surface at the top of latch stop catch incline surface 192, and latch stop catch surface 64 which is substantially normal to latch interference surface 188. Latch stop catch 190 allows latch stop lock 26 to securely engage a fixed structure disposed on female connector housing 80.

Figure 29A:
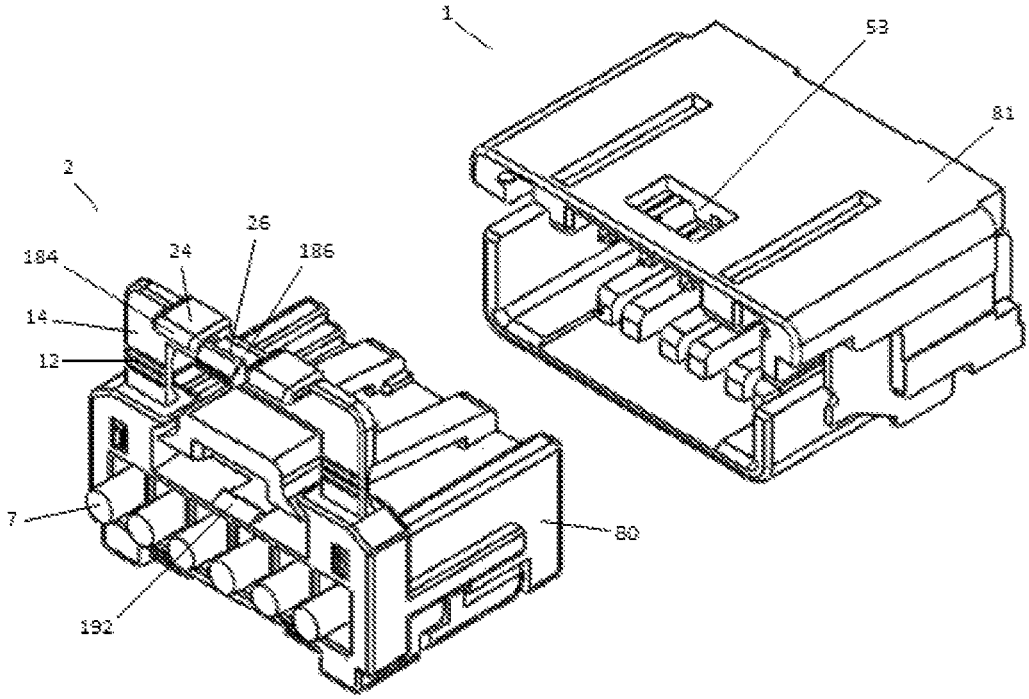
FIGS. 29*a*, 29*b*, and 29*c* are perspective views of a female connector, male connector, and latch stop mechanism of the present invention before engaging, during engaging, and after engaging.
Figure 29B:
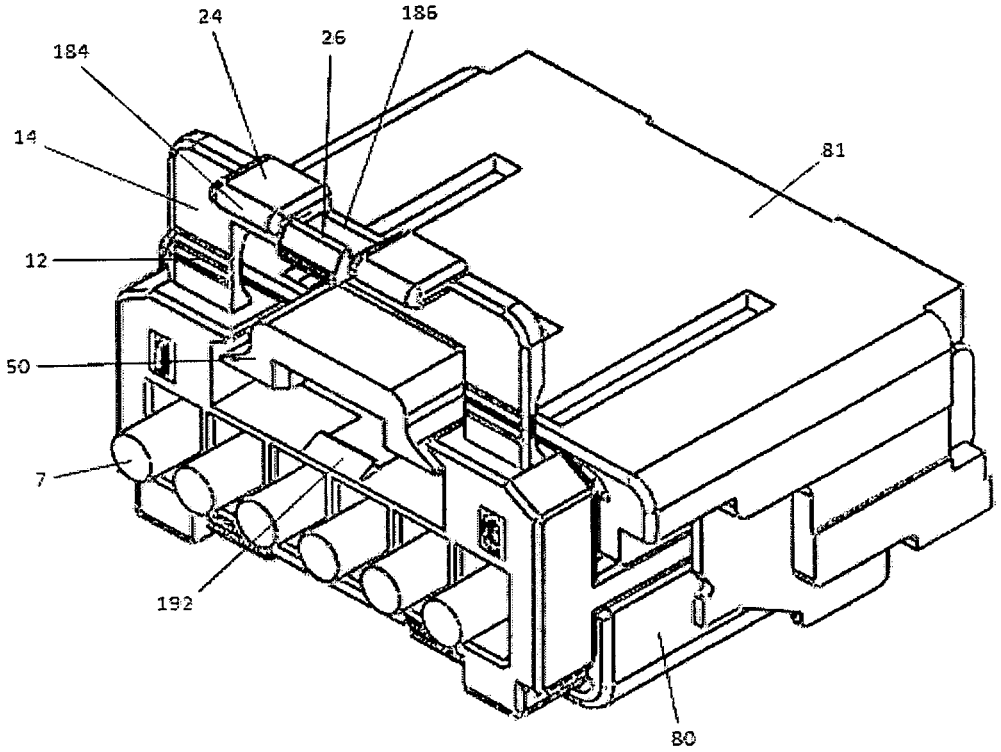
Figure 29C:
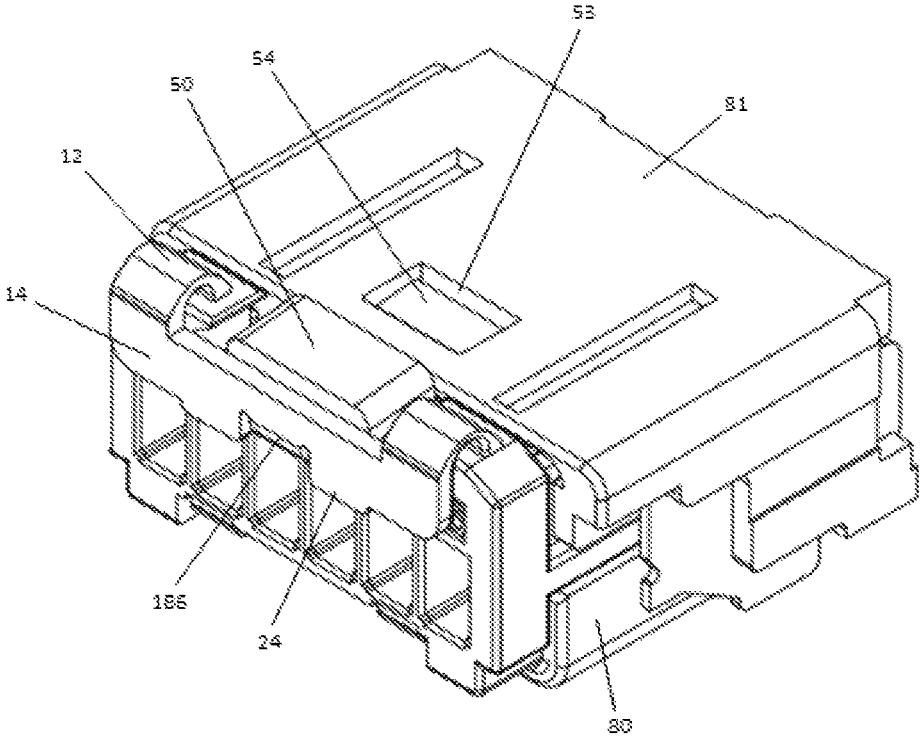
Figure 31:
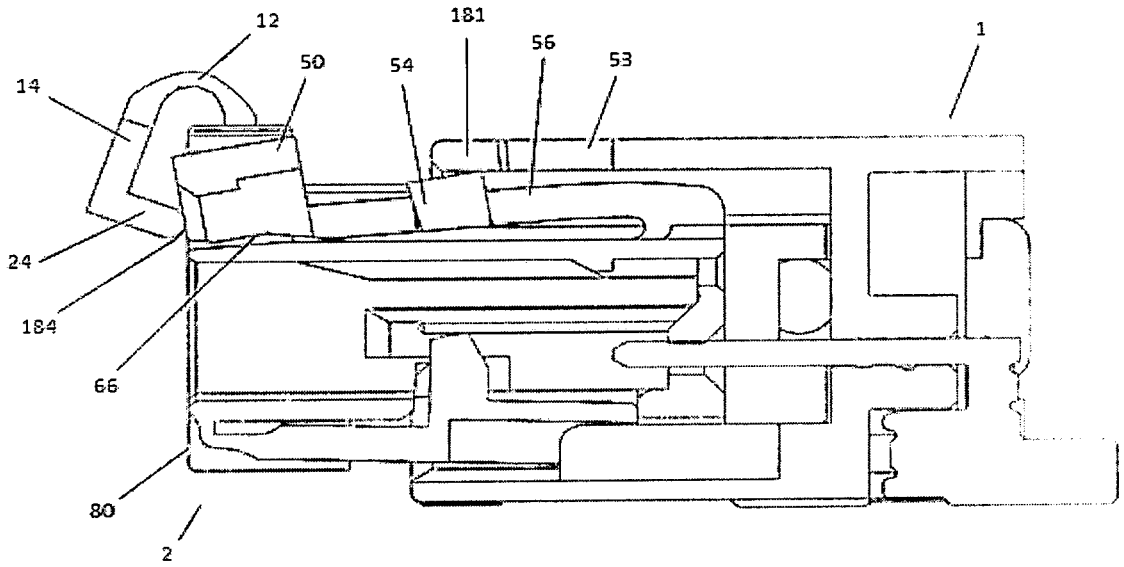
FIG. 31 is a longitudinal section view of female connector and male connector of the present invention during premature installation of the latch stop mechanism.

Steps of engagement of the present invention are shown in FIGS. 29*a*, 29*b*, and 29*c*. Female connector 2 engages with male connector 1 by fitting within male connector housing 81. Latch lock 54 fits into latch lock window 53 as shown in FIG. 29*c*. FIG. 31 depicts female connector 2 and male connector 1 when latch beam 56 is deflected to fit female connector housing 80 into male connector housing 81. Deflection of latch beam 56 may occur due to interference between latch lock 54 and a portion of the top wall of male connector 181, which results in a downward force applied to a latch beam 56. During this step, anti-stubbing feature 184 of wedge 24, and latch 50 physically interfere to prevent premature installation of latch stop mechanism 10. In a preferred embodiment, the interference allows detection of half mate condition between male connector 1 and female connector 2. Half mate refers to the in-between stages of mating: after mating starts, but before mating completion, in which male connector 1 and female connector 2 are not fully engaged. Once female connector 2 and male connector 1 are fully engaged as shown in FIG. 29*b*, latch stop mechanism 10 can properly engage as shown in FIG. 29*c*. Proximal hinge 12 bends allowing proximal section 14 to rotate 180 degrees to be adjacent to rear of female connector 42. As the user applies axial force on proximal section 14, latch stop lock incline surface 182 of latch stop lock 26 makes contact with and travels along latch stop catch incline surface 192 of latch stop catch 190. Flexure surface 180 allows latch stop lock 26 to slightly bend when latch stop lock incline surface 182 and latch stop catch incline surface 192 are in contact. After latch stop lock 26 overcomes latch stop catch 190, latch stop lock 26 is engaged with latch stop catch 190, where latch stop locking surface 28 of latch stop lock 26 makes contact with latch stop catch surface 64 of latch stop catch 190. Contact between stop locking surface 28 and latch stop catch surface 64 occurs between latch beam 56 and portion of female connector housing 80 that houses wires 7. In this embodiment, latch stop mechanism 10 engages latch stop catch 190 on the top portion of female connector housing 80, but in a different embodiment this may occur in other sections such as on the bottom side. Once latch stop mechanism 10 is fully engaged, latch stop mechanism 10 prevents unintentional disconnecting of male connector 1 and female connector 2.

Figure 30:
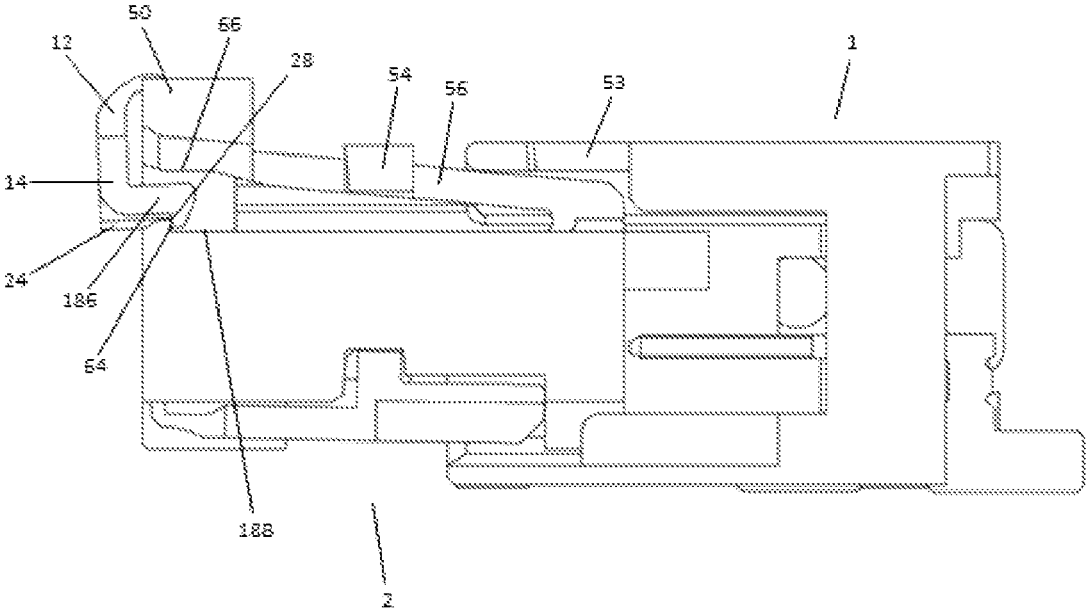
FIG. 30 is a longitudinal section view of female connector, male connector, and latch stop mechanism of the present invention when the latch stop mechanism is prematurely engaged.

FIG. 30 shows latch stop mechanism 10 fully engaged. Latch stop mechanism 10 stays engaged due to latch stop catch surface 64 contacting latch stop locking surface 28. Latch stop catch surface 64 and latch stop locking surface 28 are substantially normal to latch stop interference surface 188. In other variants, there could be a smaller angle for latch stop catch surface 64 with respect to latch stop interference surface 188 depending on the force direction of latch stop lock 26. As shown in FIG. 30, if latch stop mechanism 10 is prematurely installed, female connector 2 is unable to fit into male connector 1. When latch stop mechanism 10 is fully engaged, latch stop surface 68 of wedge 24 may contact latch stop contact surface 66, which substantially prevents deflection of latch beam 56 as shown in FIG. 32. By substantial deflection, it is intended to be understood that the amount of deflection is less than the interference between latch lock 54 and a portion of the top wall of male connector 181 such that female connector 2 and male connector 1 cannot be disengaged. Thus, latch lock 54 may not be disengaged from latch lock window 53 unless latch stop surface 68 is removed from latch cavity 62. In a preferred embodiment, latch stop surface 68 may not be removed from latch cavity 62 so long as latch stop locking surface 28 remains in contact with latch stop catch surface 64. In other words, the gap existing between wedge 24 and the bottom wall of the latch cavity 62 is smaller than the needed height to remove latch lock 54 from latch lock window 53.

The present invention may be further understood as a connector with connector position assurance, the connector comprising: a connector housing, a latch stop mechanism adjoining the connector housing, a latch adjoining the connector housing, and one or more terminals; the latch stop mechanism comprising a hinge, a section adjoining the hinge, and a latch stop lock arm disposed on the section, whereby the latch stop lock arm may rotate approximately 180 degrees around a point of rotation; and the latch is disposed on a latch beam, the latch comprising a latch stop contact surface whereby when the latch stop contact surface contacts latch stop surface disposed on the latch stop lock arm, movement of the latch is limited, and wherein when the latch stop contact surface contacts latch stop surface disposed on the latch stop mechanism, a portion of the latch stop mechanism is positioned between the latch beam and one or more terminals.

A preferred embodiment of the present invention limits movement of the latch when the latch stop contact surface contacts latch stop surface disposed on the latch stop lock arm such that the limitation of movement prevents removing a latch stop surface from a latch cavity so long as a latch stop locking surface remains in contact with a latch stop catch surface.

The present invention further includes a method for engaging a first connector having a connector position assurance including a latch stop mechanism to a second connector, the method comprising: fitting a portion of the first connector within a connector housing of the second connector; positioning a latch beam to facilitate fitting a portion of the first connector with the connector housing of the second connector; engaging the first connector with the second connector; rotating a section approximately 180 degrees so that it is positioned adjacent to a rear of one of the connectors; contacting a latch stop incline surface with a latch stop catch; engaging a latch stop lock with the latch stop catch; and fully engaging the latch stop mechanism thereby preventing unintentional disengaging of the first connector from the second connector.

The present invention further includes a method wherein the first connector is a male connector and the second connector is a female connector.

The present invention further includes a method wherein the latch beam is deflected due to interference between a latch lock and a portion of a top wall of one of the connectors.

The present invention further includes a method wherein an anti-stubbing feature disposed on a wedge disposed on the latch stop mechanism, interferes with the latch to prevent full engagement of the latch stop mechanism if the first and second connectors are not fully engaged.

The present invention further includes a method wherein interference between the latch stop mechanism and the latch detects a half mate condition between the first and second connectors.

The present invention further includes a method comprising: applying axial force on a proximal section; contacting the latch stop lock incline surface with latch stop incline surface; and causing the latch stop lock incline surface to travel along latch stop catch incline surface and bending the latch a stop lock arm when the latch stop lock incline surface contacts the latch stop catch incline surface.

The many features and advantages of the present invention are apparent from the written description and, thus, it is intended by the appended claims to cover all such features and advantages of the invention. Since numerous modifications and changes will readily occur to those skilled in the art, the invention is not limited to the construction and operation as illustrated and described. Hence, all suitable modifications and equivalents may be included as falling within the scope of the invention.

We claim:

1. A connector with connector position assurance, the connector comprising: a connector housing, a latch stop mechanism adjoining the connector housing, and a latch adjoining the connector housing;

the latch stop mechanism comprising a hinge, a section adjoining the hinge, and a latch stop lock arm disposed on the section, whereby the hinge is a live hinge and the section is rigid and supports the latch stop arm, and whereby the latch stop lock arm may rotate approximately 180 degrees around a point of rotation; and the latch comprising a latch stop contact surface whereby when the latch stop contact surface contacts latch stop surface disposed on the latch stop mechanism, movement of the latch is limited.

2. The connector with connector position assurance of claim 1 wherein the hinge connects the section to the connector housing.

3. The connector with connector position assurance of claim 1 wherein the section is a proximal section.

4. The connector with connector position assurance of claim 1 wherein movement of the latch is limited when the latch stop contact surface contacts latch stop surface disposed on the latch stop lock arm such that the limitation of movement prevents removing a latch stop surface from a latch cavity so long as a latch stop locking surface remains in contact with a latch stop catch surface.

5. A connector with connector position assurance, the connector comprising: a connector housing, a latch stop mechanism adjoining the connector housing, a latch adjoining the connector housing, and one or more terminals;

the latch stop mechanism comprising a hinge, a section adjoining the hinge, and a latch stop lock arm disposed on the section, whereby the hinge is a live hinge and the section is rigid and supports the latch stop arm, and whereby the latch stop lock arm may rotate approximately 180 degrees around a point of rotation; and the latch is disposed on a latch beam, the latch comprising a latch stop contact surface whereby when the latch stop contact surface contacts latch stop surface disposed on the latch stop lock arm, movement of the latch is limited, and wherein when the latch stop contact surface contacts latch stop surface disposed on the latch stop mechanism, a portion of the latch stop mechanism is positioned between the latch beam and one or more terminals.

6. The connector with connector position assurance of claim 5 wherein the hinge is a proximal hinge.

7. The connector with connector position assurance of claim 5 wherein the section is a proximal section.

8. The connector with connector position assurance of claim 5 wherein movement of the latch is limited when the latch stop contact surface contacts latch stop surface disposed on the latch stop lock arm such that the limitation of movement prevents removing a latch stop surface from a latch cavity so long as a latch stop locking surface remains in contact with a latch stop catch surface.

9. The connector with connector position assurance of claim 5 wherein a wedge is disposed on the latch stop mechanism.

10. The connector with connector position assurance of claim 5 wherein a wedge is disposed on the latch stop mechanism, and an anti-stubbing feature is disposed on the wedge.

* * * * *